US006427586B2

(12) United States Patent
Takahashi

(10) Patent No.: US 6,427,586 B2
(45) Date of Patent: Aug. 6, 2002

(54) PRINTER WITH A PLURALITY OF PRINT DRUMS

(75) Inventor: Mituru Takahashi, Miyagi (JP)

(73) Assignee: Tohoku Ricoh Co., Ltd., Shibata-gun (JP)

( * ) Notice: Subject to any disclaimer, the term of this patent is extended or adjusted under 35 U.S.C. 154(b) by 0 days.

(21) Appl. No.: 09/725,562

(22) Filed: Nov. 30, 2000

(30) Foreign Application Priority Data

Jan. 6, 2000 (JP) ..... 2000-000733

(51) Int. Cl.[7] ..... B41L 13/04
(52) U.S. Cl. ..... 101/116; 101/484
(58) Field of Search ..... 101/114, 115, 101/116, 119, 120, 128.4, 129, 183, 216, 484, 485, 486, 248

(56) References Cited

U.S. PATENT DOCUMENTS

| | | | | |
|---|---|---|---|---|
| 5,642,663 A | * | 7/1997 | Hara | 101/116 |
| 5,893,323 A | * | 4/1999 | Ishii | 101/116 |
| 6,067,902 A | | 5/2000 | Takahashi | |
| 6,095,040 A | * | 8/2000 | Ashikagaya et al. | 101/116 |
| 6,129,013 A | | 10/2000 | Takasawa et al. | |

FOREIGN PATENT DOCUMENTS

| | | |
|---|---|---|
| JP | 61-85462 | 6/1986 |
| JP | 64-18682 | 1/1989 |
| JP | 64-46258 | 3/1989 |
| JP | 5-229243 | 9/1993 |
| JP | 6-71998 | 3/1994 |
| JP | 6-293175 | 10/1994 |
| JP | 7-1817 | 1/1995 |
| JP | 7-17013 | 1/1995 |
| JP | 8-39916 | 2/1996 |
| JP | 8-39918 | 2/1996 |
| JP | 10-846 | 1/1998 |
| JP | 10-109470 | 4/1998 |
| JP | 10-297074 | 11/1998 |
| JP | 11-138961 | 5/1999 |
| JP | 11-151852 | 6/1999 |
| JP | 11-208085 | 8/1999 |
| JP | 11-227309 | 8/1999 |

* cited by examiner

*Primary Examiner*—Ren Yan
(74) *Attorney, Agent, or Firm*—Oblon, Spivak, McClelland, Maier & Neustadt, P.C.

(57) ABSTRACT

A printer including a plurality of print drums and capable of producing, e.g., color printings is disclosed. When a closed position sensor responsive to a door outputs a close signal and when a drum sensor assigned to a print drum to be mounted outputs an absence signal, a controller controls drum drive sections such that a mount/dismount drive section assigned to the print drum to be mounted takes the position corresponding to a mount position. Also, in response to a mount position signal output from a mount position sensor, the controller controls the drum driving device such that the mount/dismount drive section stops at the position corresponding to the mount position. The printer allows an operator thereof to mount the print drums without pressing, e.g., mount/dismount keys each time and thereby saves time.

20 Claims, 12 Drawing Sheets

PRINTER WITH A PLURALITY OF PRINT DRUMS

BACKGROUND OF THE INVENTION

The present invention relates to a stencil printer or similar printer and more particularly to a printer of the type including a plurality of print drums each for wrapping a particular master therearound and capable of producing, e.g., color printings.

A thermal, digital master masking type of stencil printer is extensively used as a simple, convenient printer. This type of stencil printer includes a thermal head having fine heat generating elements arranged in an array. While a stencil is conveyed in contact with the heat generating elements, current is selectively fed to the elements in the form of pulses in accordance with image data. As a result, the heat generating elements generate heat and form a perforation pattern in the stencil. The perforated stencil, or master, is wrapped around a porous, cylindrical print drum. Ink feeding means is arranged within the print drum so as to feed ink to the inner periphery of the print drum. A press roller or similar pressing means presses a paper sheet against the print drum via the master, causing the ink to ooze out via the porous portion of the print drum and then the perforation pattern of the master. Consequently, the ink is transferred from the print drum to the paper sheet, printing an image on the paper sheet.

A printer of the type including a plurality of print drums has recently been proposed in various forms, as taught in, e.g., Japanese Patent Laid-Open Publication Nos. 10-297074, 11-138961, 11-151852, 11-227309 and 11-208085. In this type of printer, the print drums each are removable from the body of the printer. The print drums are mechanically interconnected and driven to rotate when mounted to the body. To discharge used masters, to make masters or to change colors, the print drums are individually dismounted from the body and again mounted to the body. The problem with this configuration is that all the print drums cannot be mounted to or dismounted from the body at the same time unless a distance between nearby print drums is an integral multiple of the circumferential length of the individual print drum so as to cause the home positions of the print drums to coincide with each other. This, however, makes the entire printer bulky. To make the printer compact, it has been customary to space nearby print drums by a distance shorter than the circumferential length of each print drum while providing an initial phase difference between the nearby print drums.

Assume that the stop position, e.g., home position of the individual print drum is such that a damper mounted on the drum is positioned substantially at the bottom of the drum. Then, when the print drum is left unused over a long period of time, ink to be fed to the drum is apt to soften due to separation and leak via a seam where the damper is positioned. In light of this, the above Laid-Open Publication No. 11-227309 discloses control means capable of obviating such leakage without resorting to any treatment of the print drum and facilitating the mounting and dismounting of the drum as well as the operation of the printer. The control means controls drive means such that the print drum selectively takes a stop position where the damper lies in a preselected angular range upstream or downstream of substantially the bottom of the drum in a direction of rotation of the drum or a mount/dismount position where the damper is positioned substantially at the bottom of the drum. At the mount/dismount position, the print drum can be mounted to or dismounted from the body.

However, the scheme taught in Laid-Open Publication No. 11-227309 has the following problem left unsolved. Assume a stencil printer including a first and a second print drum. Then, in the above document, the stop positions assigned to the print drums each are coincident with the home position different from the mount/dismount position. Therefore, to mount the first drum to the body, the operator of the printer must press a first drum mount/dismount key (75A in the document) so as to cause a mount/dismount drive section assigned to the first print drum to rotate to the mount/dismount position, and then mount the first drum. Likewise, to mount the second drum to the body, the operator must press a second drum mount/dismount key (75B in the document) so as to cause a mount/dismount drive section assigned to the second print drum to rotate to the mount/dismount position, and then mount the second drum.

As stated above, every time the operator desires to mount one print drum to the body, the operator must press the mount/dismount key assigned to the print drum and simply wait until the mount/dismount drive section also assigned to the print drum reaches the mount/dismount position. Such an operation is awkward to perform and wastes time.

Technologies relating to the present invention are also disclosed in, e.g., Japanese Utility Model Laid-Open Publication Nos. 61-85462 and 64-46258, Japanese Patent Laid-Open Publication Nos. 5-229243, 6-71998, 6-293175, 7-1817, 7-17013, 8-39916, 10-109470, 64-18682, 8-39918 and 10-846, and Japanese Patent Application No. 11-184842.

SUMMARY OF THE INVENTION

It is therefore an object of the present invention to provide an easy-to-operate printer with a plurality of print drums allowing the operator of the printer to mount the print drums without pressing, e.g., mount/dismount keys each time and thereby saving time.

In accordance with the present invention, a printer includes a body and a plurality of print drums removably mounted to the body for wrapping masters therearound. An initial phase difference is provided between nearby print drums set in the body such that the print drums each can be mounted to the body in a preselected phase. The printer feeds ink to the masters while sequentially pressing a recording medium against the masters to thereby sequentially form images on the recording medium one above the other. An opening/closing member is mounted on the body and movable between a closed position where it covers openings each for mounting and dismounting a particular print drum and an open position where it uncovers the openings. A closed position sensor is responsive to the closed position of the opening/closing member. A drum driving device causes each print drum to rotate. Drum sensors each are assigned to a particular print drum for determining whether or not the print drum is present in the body. Mount/dismount drive sections are mounted on the body, and each is assigned to a particular print drum such that the mount/dismount drive section is connected to the particular print drum, which is to be mounted to the body, and the drum driving device only at a position corresponding to a mount position of the print drum, which corresponds to the preselected phase. Mount position sensors each are response to the position of associated one of the mount/dismount drive sections corresponding to the mount position. A controller controls, in response to a close signal output from the closed position sensor and an absence signal output from the drum sensor assigned to the print drum to be mounted, the drum driving device such that the mount/dismount drive section assigned to the print drum to be mounted takes the position corresponding to the mount position. Also, in response to a mount position signal output from the mount position sensor, the controller controls the drum driving device such that the mount/dismount drive section stops at the position corresponding to the mount position.

Also, in accordance with the present invention, a printer includes a body and a plurality of print drums removably mounted to the body for wrapping masters therearound. An initial phase difference is provided between nearby print drums. The printer feeds ink to the masters while sequentially pressing a recording medium against the masters to thereby sequentially form images on the recording medium one above the other. The print drums each are capable of stopping at a respective home position. Home position sensors each re responsive to the home position of a particular print drum. A home stop priority setting device allows the operator of the printer to select a home stop priority mode, which causes the print drums to stop at respective home positions, neglecting a preselected priority order given to the stop positions of the print drums. An opening/closing member is mounted on the body and movable between a closed position where it covers openings each for mounting and dismounting a particular print drum and an open position where it uncovers the openings. A closed position sensor is responsive to the closed position of the opening/closing member. A drum driving device causes each print drum to rotate. Drum sensors each are assigned to a particular drum for determines whether or not the drum is present in the body. In response to a close signal output from the closed position sensor, presence signals output from the drum sensors and a home stop priority signal output the the home stop priority setting device, the controller controls the drum driving device such that the print drums each take the respective home position, Also, in response to home position signals output from the home position sensors, the controller controls the drum driving device such that the print drums each stop at the respective home position.

Further, in accordance with the present invention, a printer includes a body and a plurality of print drums removably mounted to the body for wrapping masters therearound. An initial phase difference is provided between nearby print drums set in the body such that the print drums each can be dismounted from the print drum in a preselected phase. The printer feeds ink to the masters while sequentially pressing a recording medium against the masters to thereby sequentially form images on the recording medium one above the other. A specified drum stop priority setting device allows the operator of the printer to select a specified drum stop priority mode, which causes any one of the print drums to stop in the preselected phase, neglecting a preselected priority order given to the stop positions of the print drums. An opening/closing member is mounted on the body and movable between a closed position where it covers openings each for mounting and dismounting a particular print drum and an open position where it uncovers the openings. A closed position sensor is responsive to the closed position of the opening/closing member. A drum driving device causes each print drum to rotate. Drum sensors each are assigned to a particular print drum for determining whether or not the drum is present in the body. Mount/dismount position sensors are mounted on the body, and each is assigned to a particular print drum for sensing the preselected phase of the particular print drum. In response to a close signal output from the closed position sensor, presence signals output from the drum sensors and a specified drum stop priority signal output from the specified drum stop priority setting device, the controller controls the drum driving device such that the print drum specified takes the preselected phase. Also, in response to a mount/dismount position signal output from the mount/dismount position sensor, controller controls the drum driving device such that the print drum specified stops at the mount/dismount position.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
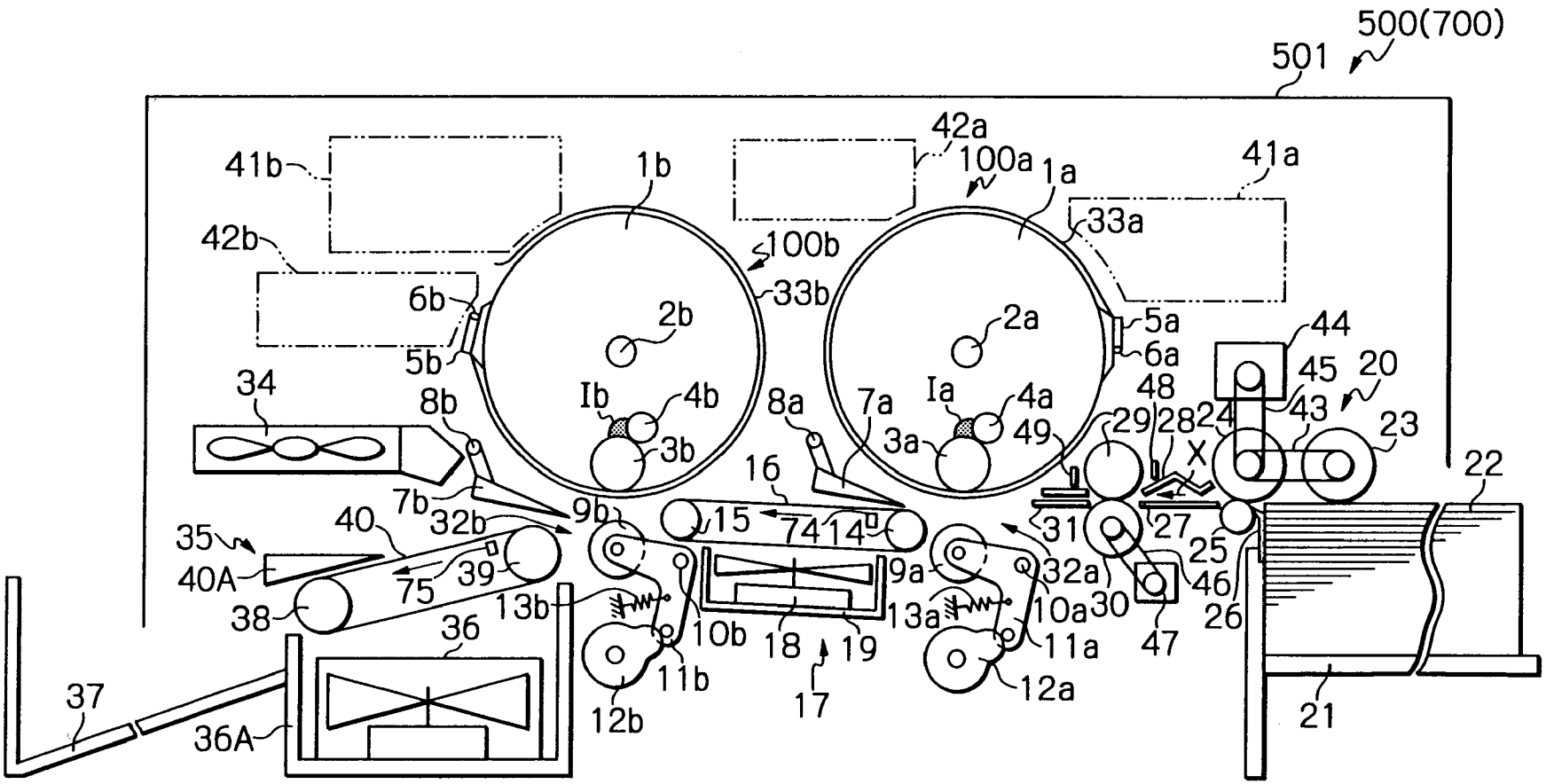
FIG. 1 is a front view of a stencil printer including a plurality of print drums with which a preferred embodiment of the present invention and a modification thereof are practicable.

A preferred embodiment of the printer in accordance with the present invention and a modification thereof will be described hereinafter. In the embodiment and modification thereof, structural elements identical in function and configuration are designated by identical reference numerals and will not be repeatedly described in order to avoid redundancy. Members and structural parts expected to be shown in the figures, but not necessary to be described with reference to the figures, will be omitted for the simplicity of illustration and description. Further, as for members and structural elements provided in pairs, only one of them will be described for the sake of simplicity so long as distinction is not necessary.

Referring to FIG. 1 of the drawings, a type stencil printer embodying the present invention is shown and generally designated by the reference numeral 500. As shown, the stencil printer 500 includes a generally box-like body frame 501. A first and a second print drum 1*a* and 1*b* are respectively arranged at an upstream side and a downstream side in a direction X in which a paper sheet or similar recording medium 22 is conveyed (direction of paper conveyance X hereinafter), as viewed in FIG. 1. A preselected initial phase difference is provided between the two drums 1*a* and 1*b* such that the drums 1*a* and 1*b* can be mounted to or dismounted from the body frame 501 when the phase difference is set up therebetween. Masters 33*a* and 33*b* are wrapped around the print drums 1*a* and 1*b*, respectively. While ink is fed to the maters 33*a* and 33*b* via the print drums 1*a* and 1*b*, the paper sheet 22 is sequentially pressed against the print drums 1*a* and 1*b* via the masters 33*a* and 33*b*. As a result, in the illustrative embodiment, images of two different colors are printed on the paper sheet 22 one above the other.

While the illustrative embodiment concentrates on two print drums 1*a* and 1*b* arranged in the direction of paper conveyance X, the present invention is, of course, practicable with three or more print drums arranged in the direction X for producing color printings in three or more colors.

Mounting/dismounting means 50*a* and 50*b* (see FIG. 3) are respectively assigned to the drums 1*a* and 1*b* for allowing the drums 1*a* and 1*b* to be mounted and dismounted from the body frame 501, as needed. A door 503 (see FIG. 6) is hinged to the body frame 501 for selectively covering or uncovering openings 501*a* and 501*b* formed in the body frame 501. The print drums 1*a* and 1*b* are mounted to or dismounted form the body frame 501 via the openings 501*a* and 501*b*, respectively. Drum drive means 80 (see, e.g., FIG. 2) causes the drums 1*a* and 1*b* to rotate. Mount/dismount drive sections or means 95*a* and 95*b* (see FIGS. 4A, 4B and 5) are mounted on the body frame 501 and assigned to the print drums 1*a* and 1*b*, respectively. The mount/dismount drive sections 95*a* and 95*b* are connected to the drum drive means 80 and are connectable to the print drums 1*a* and 1*b*, respectively, at respective positions corresponding to the preselected phases (mount/dismount positions) of the print drums 1*a* and 1*b*, which are to be mounted or dismounted. The mount/dismount drive sections 95*a* and 95*b* each can stop at the above respective position. An operation panel 170 (see FIG. 7) allows a person to operate the stencil printer 500. A control system (see FIG. 8) includes a controller 200, which will be described specifically later.

Figure 9:
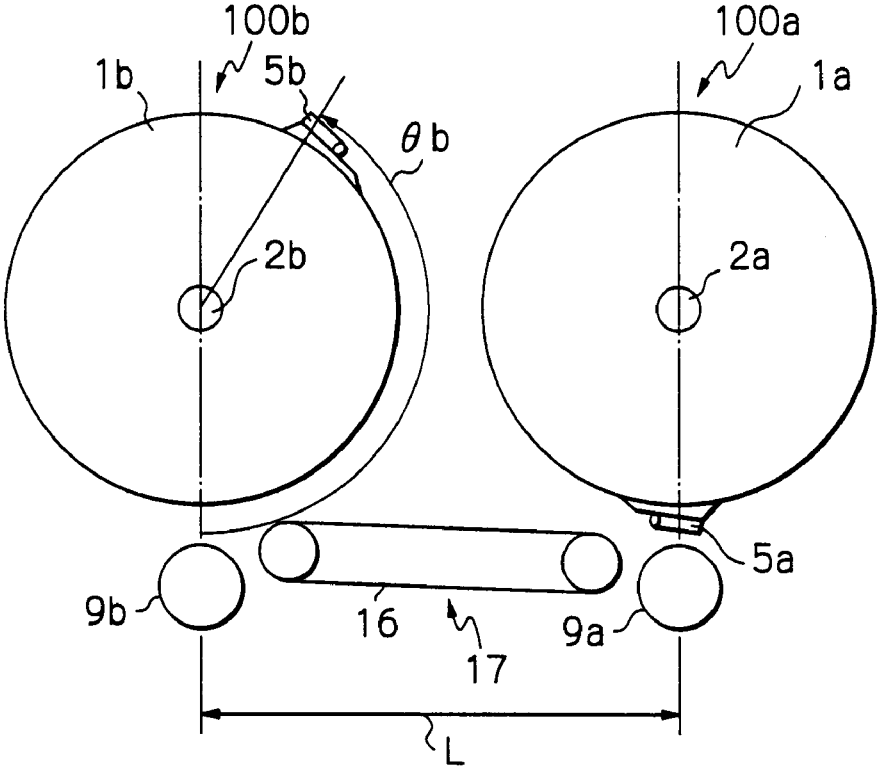
FIGS. 9 and 10 are views respectively showing preselected positions assigned to a first and a second drum.
Figure 10:
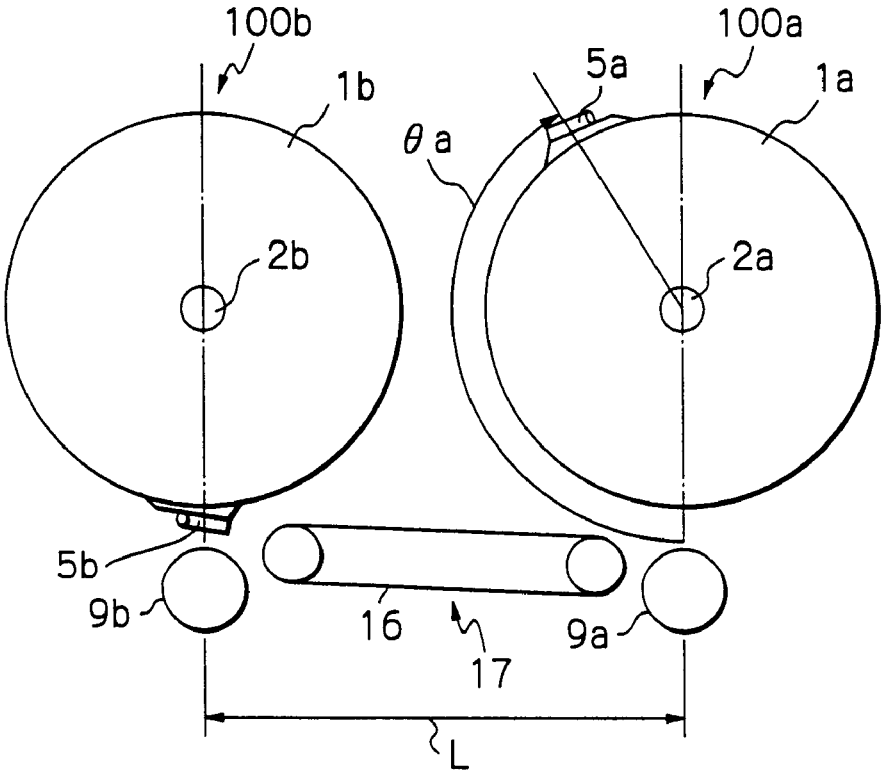

As shown in FIG. 1, the print drums 1*a* and 1*b* each can stop at a respective home position and a respective mount/dismount position. Clampers 5*a* and 5*b* are mounted on the print drums 1*a* and 1*b*, respectively. The home positions of the print drums 1*a* and 1*b* are such that the dampers 1*a* and 1*b* do not face substantially vertically downward, but face vertically upward. As shown in FIGS. 9 and 10, the mount/dismount positions are such that the print drums 1*a* and 1*b* can be mounted or dismounted from the body frame 501 in the respective preselected phases.

First, the general construction of the stencil printer will be described with reference to FIG. 1. It to be noted that master making devices 41*a* and 41*b* and master discharging devices 42*a* and 42*b* indicated by dash-and-dots lines are not arranged or used in the illustrative embodiment.

The drums 1*a* and 1*b* are substantially identical in configuration with each other. Likewise, the mounting/dismounting means 50*a* and 50*b* and the mount/dismount drive sections 95*a* and 95*b* each are substantially identical in configuration and operation with each other. This is also true with ink feeding means arranged inside and outside the print drum 1*a* and those arranged inside and outside the print drum 1*b*. Such constituents are therefore simply distinguished from each other by suffixes a and b, and only one of them will be described for simplicity.

A sheet feeder 20 is positioned below and at the right-hand side of the print drum 1*a* for feeding paper sheets 22 stacked on a tray 21 one by one. A pressing device 32*a* presses the paper sheet 22 brought to a position below the print drum 1*a* against the master 33*a* wrapped around the drum 1*a*. An air knife 7*a* peels off the paper sheet 22 from the drum 1*a* after an image has been printed on the paper sheet 22 at the above position. A pressing device 32*b* presses the paper sheet 22 brought to a position below the print drum 1*b* against the master 33*b* wrapped around the print drum 1*b*. A conveyor 17 intervenes between the pressing devices 32*a* and 32*b* for conveying the paper sheet 22 on which an image has been printed at the above position over the image existing on the paper sheet 22. An air knife 7*b* peels off the paper sheet, or bicolor printing, 22 from the print drum 1*b*. A paper discharging device 35 discharges the bicolor printing 22 to a tray 37 and includes the air knife 7*b*.

The illustrative embodiment does not include the master making devices 41*a* and 41*b*, the master discharging devices 42*a* and 42*b* or a scanner conventionally mounted on the top of a stencil printer. Instead, in a thermal, digital master making type of stencil printer system in which a scanner, master discharging devices and master making devices are arranged separately from the stencil printer 500, as shown in FIG. 4 of the previously mentioned Laid-Open Publication No. 11-208085, the maters 33*a* and 33*b* are wrapped around the print drums 1*a* and 1*b* and then discharged as used masters via drum units 100*a* and 100*b*, respectively. The stencil printer 500 shares the same drum units and structural elements with the thermal, digital master making type of stencil printer. This allows different models to share various parts and thereby makes the stencil printer 500 simple, small size, and low cost.

The print drum 1*a* is a conventional porous, hollow cylinder rotatably mounted on a drum shaft 2*a* and extends in the axial direction of the drum shaft 2*a*. The print drum 1*a* is made up of a metallic hollow core, not shown, including a porous portion formed with a number of fine pores, and a mesh screen layer, not shown, covering the core and formed of resin or metal, as shown in FIG. 4 of the previously mentioned Laid-Open Publication No. 11-138961. The porous portion of the core allows ink to pass through the pores thereof. More specifically, the core has a print area formed with the above pores and extending over a preselected circumferential range except for a portion around the clamper 5*a*, and a non-print area not formed with pores. The non-print area is provided at opposite edge portions of the core also.

The clamper 5*a* mentioned earlier is hinged to the outer periphery of the print drum 1*a* via a shaft 1*a* and extends in the axial direction of the drum 1*a*. The clamper 5*a* is capable of closing to clamp the leading edge of the mater 33*a*. In the thermal, digital master making type of stencil printer, opening/closing means is located at a suitable position around the print drum 1*a* and opens and closes the clamper 5*a* at a preselected position, although not shown specifically.

Figure 2:
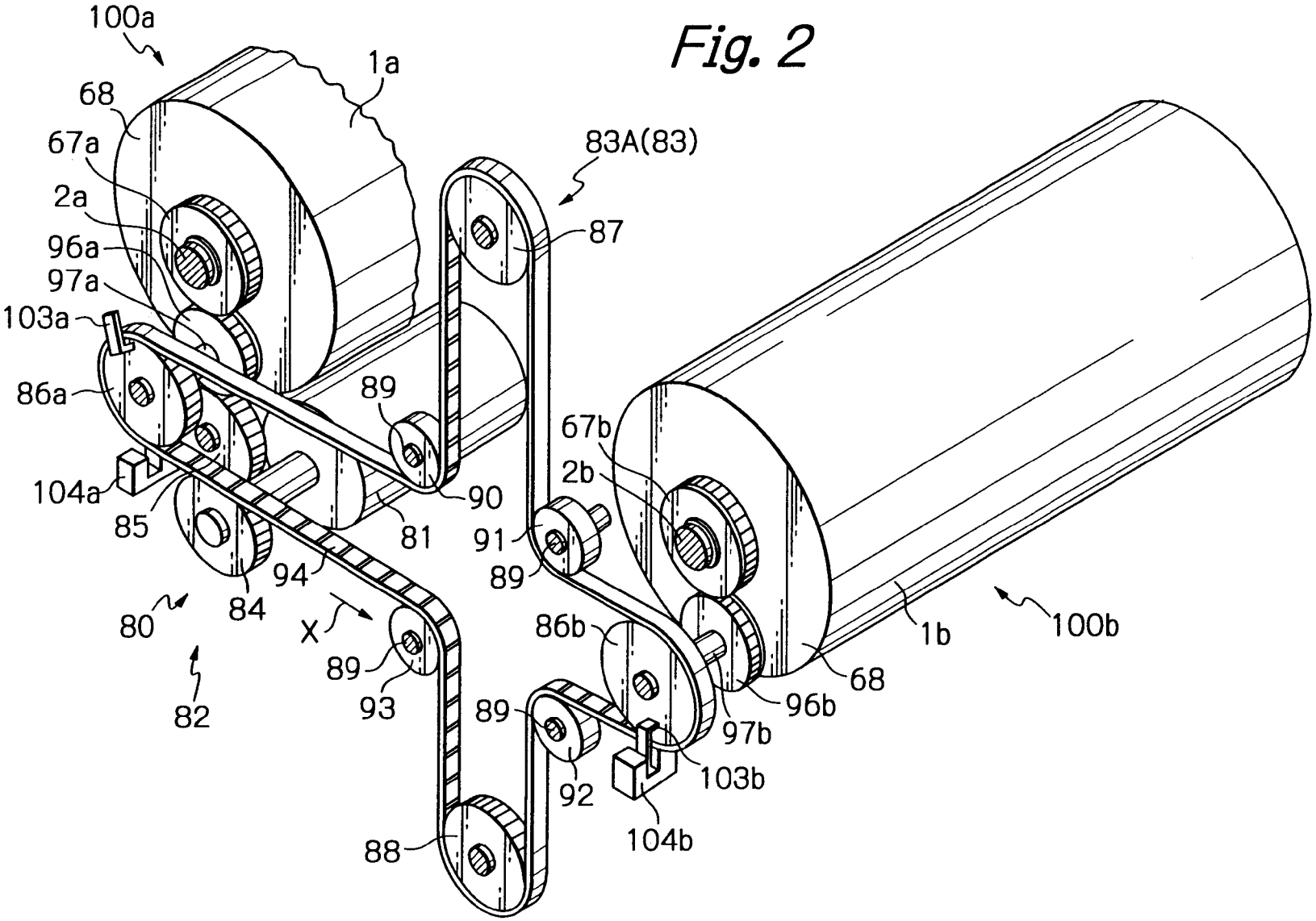
FIG. 2 is a fragmentary isometric view showing drum drive means, drive transmitting means and rotation transmitting means included in the printer of FIG. 1.
Figure 3:
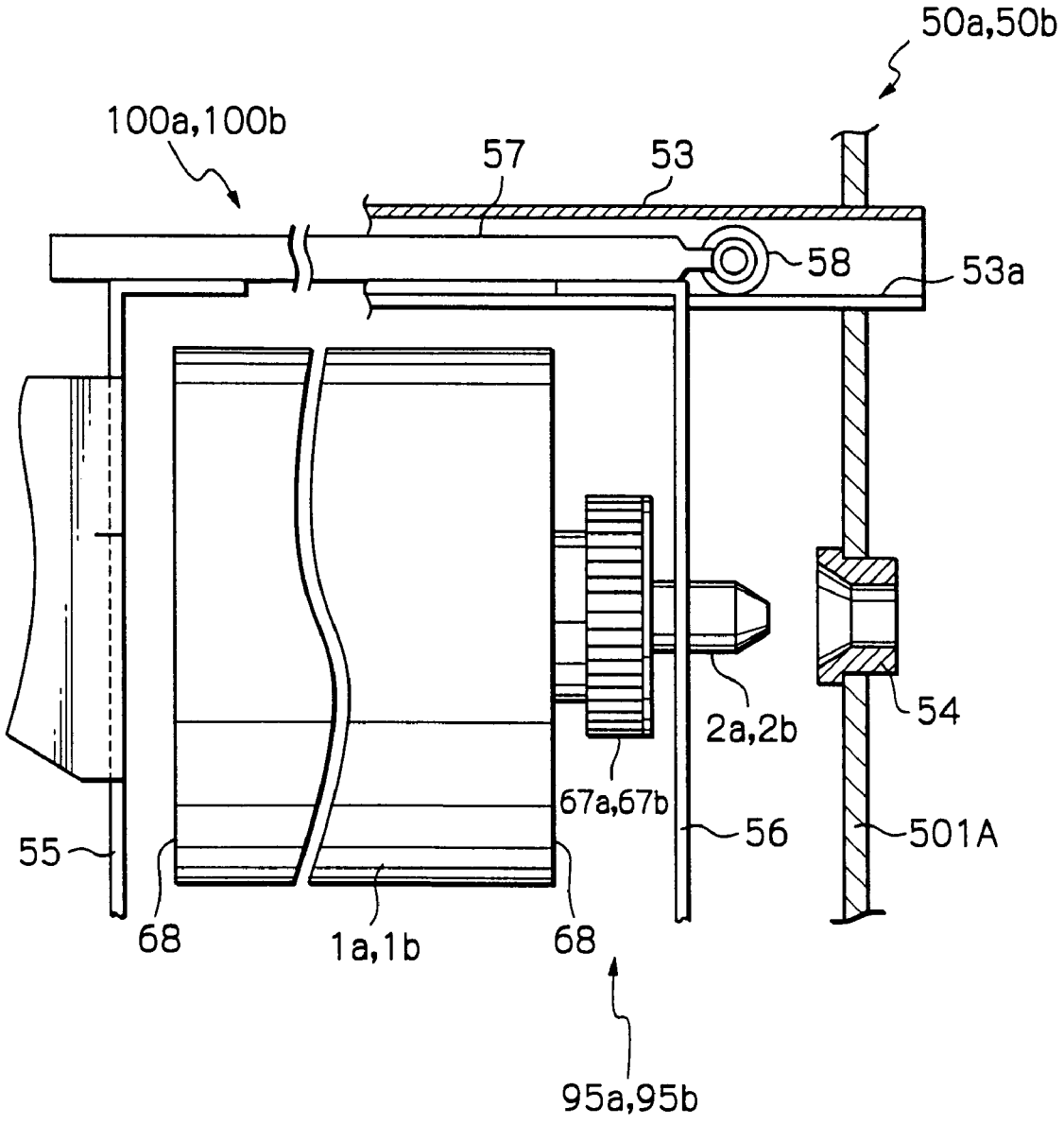
FIG. 3 is a fragmentary sectional view showing a drum unit and mounting/dismounting means also included in the printer of FIG. 1.

As shown in FIGS. 2 and 3, the print drum 1*a* is fastened to the circumferences of a pair of disk-like end plates 68 at opposite ends thereof by screws. The drum shaft 2*a* is supported by a front frame 55 and a rear frame 56. A roller bearing, not shown, intervenes between the center of each end plate 68 and the drum shaft 2*a*, so that the print drum 1*a* is freely rotatable on the drum shaft 2*a*. A drum gear 67*a* is mounted on the center of the right end plate 68, as seen in FIG. 3. A main motor 81 (see FIG. 2) causes the print drum 1*a* to rotate via the mount/dismount drive section 95*a* and drum gear 67*a*.

As shown only in FIG. 1, ink feeding means is arranged within the print drum 1*a* for feeding ink from the inner periphery to the outer periphery of the drum 1*a*. The ink feeding means feeds ink of a first color, e.g., black ink to the print drum 1*a*. Ink feeding means arranged in the other print drum 1*b* feeds ink of a second color, e.g., magenta ink (red ink hereinafter) to the drum 1*b*. Specifically, the ink feeding means in the print drum 1*a* includes an ink roller 3*a* for feeding the black ink to the inner periphery of the drum 1*a*. A doctor roller 4*a* forms an ink well 1a between it and the ink roller 3*a*. An ink feed tube 2*a*, which is implemented by the drum shaft 2*a*, feeds the black ink to the ink well 1*a*.

An ink container, not shown, filled with the black ink is mounted on the drum unit 100*a*, which will be described specifically later. An ink pump, not shown, feeds the black ink under pressure from the ink pack to the ink feed tube or drum shaft 2*a*. Ink sensing means, e.g., one shown in FIG. 5 of the Laid-Open Publication No. 5-229243 mentioned earlier senses the amount of the black ink existing in the ink well 1*a*. The delivery from the ink pump is controlled in accordance with the output of the ink sensing means.

The ink roller 3*a* is formed of aluminum, stainless steel or similar metal or rubber by way of example. A gear train, not shown, causes the ink roller 3*a* to rotate clockwise, as viewed in FIG. 1, together with the print drum 1*a*. A preselected speed ratio is set between the ink roller 3*a* and the print drum 1*a*. The doctor roller 4*a* is formed of iron, stainless steel or similar metal and caused to rotate counterclockwise, as viewed in FIG. 1, by a gear train not shown. A preselected speed ratio is also set between the doctor roller 4*a* and the print drum 1*a*.

A stencil for forming the master 33*a* is implemented by a polyester or similar thermoplastic resin film and Japanese paper or similar porous base adhered thereto. Alternatively, the stencil may be implemented by an extremely thin, thermoplastic resin film only (about 1 $\mu$m to 8 $\mu$m thick). Further, use may be made of a stencil not as thin as the above thermoplastic resin film, but thinner (20 $\mu$m to 30 $\mu$m) than the conventional stencil 33*a* (about 40 $\mu$m to 50 $\mu$m), and includes a base whose synthetic fiber content is great. An example of this kind of stencil is one including a base entirely implemented by polyethylene terephthalate (PET).

The paper feeder 20 includes the previously mentioned tray 21 that is elevatable. A pickup roller 23 and a separator roller 24 are rotatably supported by opposite side walls not shown. Another separator roller 25 is pressed against the separator roller 24A. An upper and a lower registration roller 29 and 30 convey the leading edge of the paper sheet 22 toward a print position between the print drum 1*a* and a press roller 9*a* at a preselected timing. An upper and a lower guide 28 and 27 guide the leading edge of the paper sheet 22 to a nip between the two registration rollers 29 and 30. An upper and a lower registration guide 31 guide the leading edge of the paper sheet 22 to the above print position. A paper feed motor 44, which is independent of the main motor 81, causes the pickup roller 23 and separator roller 24 to rotate. A registration motor 47, which is also independent of the main motor 81, causes the registration rollers 29 and 30 to rotate. A lead edge sensor 48 is positioned on a paper conveyance path between the separator roller 24 and the registration rollers 29 and 30 and responsive to the leading edge of the paper sheet 22. A registration sensor 49 is positioned on a paper conveyance path between the registration rollers 29 and 30 and the print drum 1*a* for sensing the leading edge of the paper sheet 22.

The elevatable tray 21 is mounted on the body of the paper feeder and loaded with a stack of paper sheets 22. A motor, not shown, causes the tray 21 to move upward or downward in accordance with the amount of the paper sheets 22 existing on the tray 21.

The pickup roller 23 and separator rollers 24 and 25 are so positioned as to contact the top paper sheet 21 on the tray 21. The separator rollers 24 and 25 cooperate with a separator plate 26 to separate the top paper sheet 22 being paid out by the pickup roller 23 from the underlying paper sheets 22. The pickup roller 23, separator rollers 24 and 25 and separator plate 26 constitute paper feeding means for feeding the leading edge of the paper sheet 22 toward the registration rollers 29 and 30.

The paper feed motor 44, which is implemented by a stepping motor, plays the role of paper feed drive means for causing the separator roller 24 and pickup roller 23 to rotate. A toothed endless belt 45 is passed over a drive pulley mounted on the output shaft of the paper feed motor 44 and a driven pulley mounted on the shaft of the separator roller 24. The rotation of the paper feed motor 44 is therefore transferred to the separator roller 24 via the belt 45, causing the roller 24 to rotate clockwise, as viewed in FIG. 1. Another toothed endless belt 43 is passed over the driven pulley associated with the separator roller 24 and a pulley mounted on the shaft of the pickup roller 23. A one-way clutch, not shown, is mounted on each of the shafts of the separator roller 24 and pickup roller 23. In this configuration, the separator roller 24 and pickup roller 23 are rotatable only clockwise, as viewed in FIG. 1, via the belt 43.

The paper sheet 22 abuts against a portion of the registration rollers 29 and 30 just short of the nip between the rollers 29 and 30, so that the leading edge port ion of the paper sheet 22 bends upward along the upper guide plate 28. The registration rollers 29 and 30 then nip the leading edge of the paper sheet 22 and convey it toward the print position between the print drum 1*a* and the press roller 9*a* at a preselected timing.

The registration motor 47, also implemented by a stepping motor, plays the role of registration drive means for causing the lower registration roller 30 to rotate. A toothed endless belt 47 is passed over a drive pulley mounted on the output shaft of the registration motor 47 and a driven pulley mounted on the shaft of the registration roller 30, connecting the motor 47 to the registration roller 30.

The lead edge sensor 48 and registration sensor 49 each are implemented by a reflection type optical sensor made up of a light emitting portion and a light-sensitive portion. The upper guide 28 and registration guide 31 each are formed with openings, not shown, for passing light issuing from the above light emitting portion and light reflected from the leading edge of the paper sheet 22.

The lead edge sensor 48 determines whether or not the paper sheet 22 has jammed an upstream path, including the paper feeding means, in the direction of paper conveyance X by sensing the leading edge of the paper sheet 22. In addition, the lead edge sensor 48 joins in control over the amount of the bend of the paper sheet 22 that occurs at the position just short of the nip between the registration rollers 29 and 30. The registration sensor 49 determines whether or not the paper sheet 22 has jammed an upstream path, including the registration rollers 29 and 30, in the direction of paper conveyance X by sensing the leading edge of the paper sheet 22. Also, the output of the registration sensor 49 is sent to the controller 200, FIG. 8, for correcting the amount of slip of the paper sheet 22 on the registration rollers 29 and 30, which varies in accordance with the kind of the paper sheet 22.

The pressing device 32*a* includes a generally L-shaped bracket 11*a*, a tension spring 13*a* and a cam 12*a* in addition to the ink roller 3*a* and press roller 9*a*. The press roller or pressing means 9*a* presses the paper sheet 22 against the print drum 1*a*, so that an image is printed on the paper sheet 22. Specifically, the press roller 9*a* is rotatably supported by one end of he bracket 11*a* and movable into and out of contact with the print drum 1*a*. The tension roller 13*a* is anchored to the other end portion of the bracket 11*a*, implementing a pressure that presses the press roller 9*a* against the print drum 1*a*. The other end of the bracket 11*a* is pressed against the contour of a generally pear-shaped cam 12*a*. The cam 12*a* is operatively connected to the drum drive means 80, which includes the main motor 81, and caused to rotate in synchronism with the paper feed from the paper feeder 20 and the rotation of the print drum 1*a*. When the paper sheet 22 is not fed from the paper feeder 20, a larger diameter portion included in the cam 12*a* contacts the end of the bracket 11*a*. When the paper sheet 22 is fed from the paper feeder 20, the cam 12*a* is rotated to bring its smaller diameter portion into contact with the end of the bracket 11*a*. As a result, the press roller 9*a* is rotated clockwise, as viewed in FIG. 1, and pressed against the print drum 1*a* under the action of the tension spring 13*a*.

The air knife 7*a* has an edge implemented as a nozzle for preventing the paper sheet 22 from adhering to the print drum 1*a* and rolling up together with the drum 1*a*. Specifically, a pump or air pressure source feeds compressed air to the nozzle, so that a stream of compressed air is sent toward the leading edge of the paper sheet 22 in synchronism with the conveyance of the paper sheet 22. The air knife 7*a* is movable about a shaft 8*a* between an operative position where it faces the print drum 1*a* and an inoperative position where it is spaced from the drum 1*a*. More specifically, the air knife 7*a* is angularly moved in synchronism with the rotation of the print drum 1*a* such that the edge thereof does not interfere with the edge of the clamper 5*a*. On the other hand, a fan or blower 34 is positioned at the left-hand side of the air knife 7*b* assigned to the print drum 1*b*. The fan 34 helps the air knife 7*b* peel off the paper sheet 22 and prevent it from rolling up together with the print drum 1*b*.

The conveyor 17 includes a porous belt 16 passed over a drive roller 15 and a driven roller 14, a suction fan 18, and a casing 19. At least the surface of the belt 16 is formed of urethane rubber or similar material having a great coefficient of friction with respect to the paper sheet 22, so that the belt 16 pulls the paper sheet 22 leftward, as viewed in FIG. 1. However, the paper sheet 2 moves to the left at a speed equal to the peripheral speed of the print drum 1*a*, because the upstream portion of the paper sheet 22 is still nipped between the print drum 1*a* and the press roller 9*a* (print position). The belt 16 is caused to move at a speed equal to or slightly higher than the peripheral speed of the print drum 1*a* in synchronism with the rotation of the drum 1*a*. The belt 16 therefore conveys the paper sheet 22 to the left in FIG. 1 while exerting tension thereon. The suction fan 18 is disposed in the casing 19 and rotated to generate vacuum in the casing 19.

The paper discharging device 35 includes a porous belt 40 passed over a drive roller 38 and a driven roller 39, a jump board 40A, a suction fan 36, and a casing 36A. The belt 40 is driven at a speed substantially equal to the peripheral speed of the print drum 1*b* in synchronism with the rotation of the drum 1*b*. Air sent from the fan 34 hits against the surface of the paper sheet or printing 22 in order to prevent the paper sheet 22 from rising above the belt 40 and to dry the ink deposited on the paper sheet 22. The jump board 40A causes the center portion of the paper sheet 22 to bend in the form of a letter U, so that the paper sheet 22 can be neatly stacked on the tray 37 with adequate rigidity.

Figure 6:
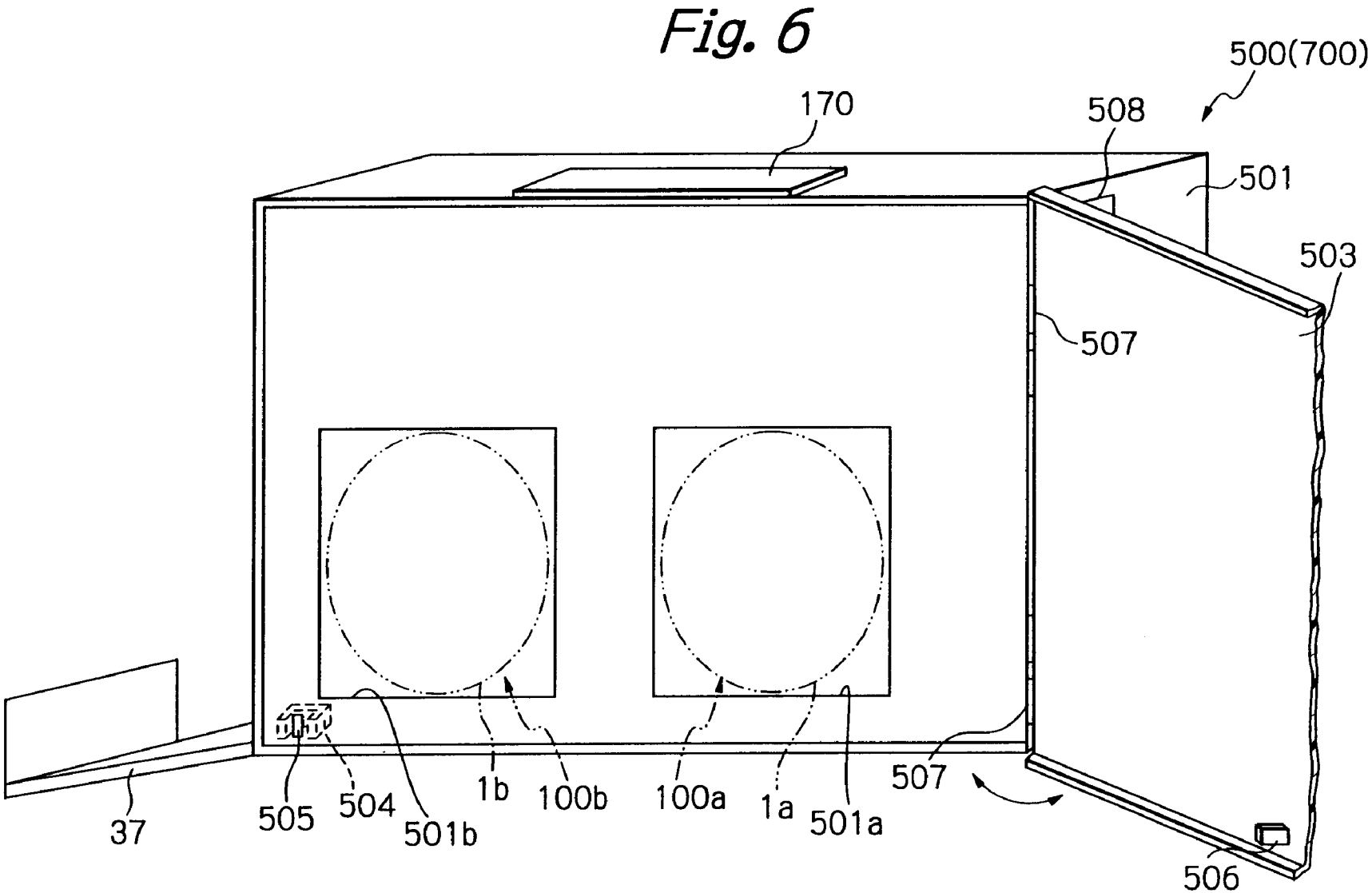
FIG. 6 is an isometric view showing openings formed in a body frame, which is also included in the printer of FIG. 1, and a door for covering and uncovering the openings.

As shown in FIG. 3, the drum unit 100*a* allows the print drum 1*a* to be mounted and dismounted from the body frame 501 via the mounting/dismounting means 50*a*. Likewise, the drum unit 100*b* allows the print drum 1*b* to be mounted and dismounted from the body frame 501 via the mounting/dismounting means 50*b*. The left-hand side and right-hand side, as viewed in FIG. 3 will sometimes be referred to as the front and rear, respectively. As shown in FIG. 6, the previously mentioned openings 501*a* and 501*b* are formed in the front end of the body frame 501 and assigned to the drum units 100*a* and 100*b*, respectively.

Figure 5:
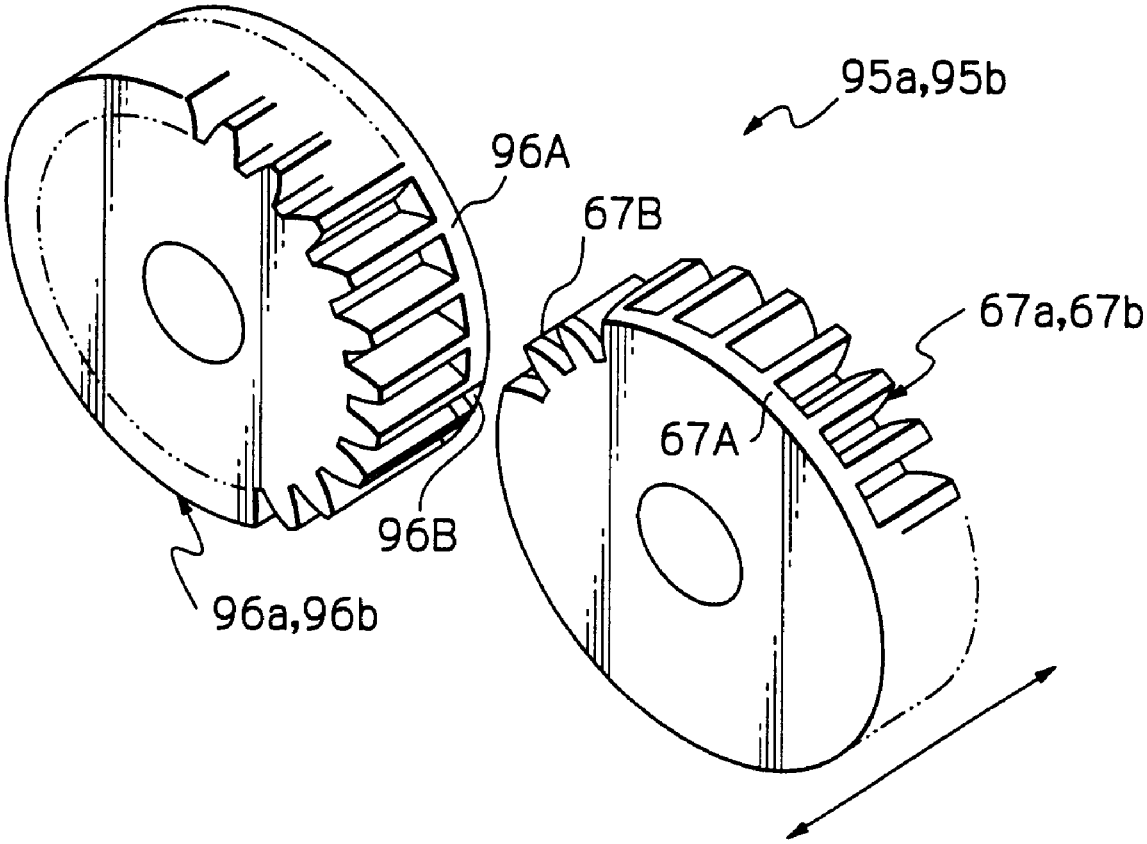
FIG. 5 is an isometric view showing a condition in which the drive gear and drum gear can mesh with each other.

As shown in FIG. 3, a rear plate 501A is mounted on the body frame 501 at the rear (right-hand side in FIG. 3) of the openings 501*a* and 501*b*. As shown in FIGS. 3 and 5, the mount/dismount drive sections 95*a* and 95*b* are arranged on the rear plate 501A and detachably connect the rear ends of the drum shafts 2*a* and 2*b*, respectively, and members associated therewith. Bearings 54 are also mounted on the rear plate 501A for supporting the rear ends of the drum shafts 2*a* and 2*b*, respectively. Further arranged on the rear plate 501A are structural elements forming part of the drum drive means 80.

As shown in FIG. 3, the drum unit 100*a* includes a container holder, not shown, for holding the previously mentioned ink container, a front knob, not shown, and a grip frame 57 in addition to the previously stated print drum 1*a*, end plates 68, drum shaft 2*a*, ink feeding means, ink pump, front frame 55, and rear frame 56. Likewise, the drum unit 100*b* includes a container holder, not shown, for holding a red ink container, a front knob, not shown, and a grip frame 57 in addition to the print drum 1*b*, end plates 68, drum shaft 2*a*, ink feeding means, ink pump, front frame 55, and rear frame 56.

A structure, means and so forth, which will be described later, allow each of the drum units 100*a* and 100*b* to be mounted to or dismounted from the body frame 501 only when it is held in a particular preselected phase. The drum units 100*a* and 100*b* are substantially identical in function and configuration, so that their constituents are distinguished from each other simply by suffixes a and b. Because the above structures, means and so forth are also identical, they will be designated by the same reference numerals for the simplicity of illustration, and only one of them will be described.

As shown in FIG. 3, the mounting/dismounting means 50*a* includes a pair of rollers 58 (only one is visible), a guide rail 53 and a pair of inlet rollers, not shown, as well as the drum shaft 2*a*, front frame 55, rear frame 56, and grip frame 57. While part of the mounting/dismounting means 50*a* is not shown in FIG. 3, it may be identical with, e.g., a drum support arrangement shown in FIGS. 1 through 4 of the previously mentioned Laid-Open Publication No. 61-85462. Further, the mounting/dismounting means 50*a* may be implemented by any one of a configuration shown in FIGS. 1 and 2 of the previously mentioned Laid-Open Publication No. 64-46258, holding means 36 and print drum device 55 shown in FIGS. 2 and 3 of Laid-Open Application No. 5-229243, an arrangement shown in FIG. 3 of Laid-Open Publication No. 6-71998, an arrangement shown in FIG. 1 of Laid-Open Publication No. 6-293175, and an arrangement shown in FIG. 2 of Laid-Open Publication No. 7-1817.

In FIG. 4, annular fixing members, not shown, are fixed to opposite ends of the drum shaft 2*a*. The front frame 55 and rear frame 56 are respectively fastened to the inner surfaces of the fixing members by screws. The front frame 55 and rear frame 56 are fixed to opposite end portions of the grip frame 57, which is implemented as a top-open channel, at upper ends thereof. The rollers 58 are rotatably mounted on a shaft and respectively positioned at the front and rear in the direction perpendicular to the sheet surface of FIG. 4.

The guide rail 53 is mounted on the body frame 501 above the openings 501*a* and 501*b* while the grip frame 57 is detachably held by the guide rail 53. The guide rail 53 is implemented as a bottom-open channel extending in the axial direction of the print drum 1*a*. The inlet rollers mentioned earlier are rotatably mounted on a shaft and positioned at the front end or inlet of the guide rail 53.

The drum unit 100*a* is inserted into the guide rail 53 with the rollers 58 of the grip frame 57 at the head, while being guided by the inlet rollers. Also, the drum unit 100*a* is pulled out of the guide rail 53 with the rollers 58 at the tail. At this instant, the rollers 58 roll on a pair of rail flanges 53*a* extending from opposite edges of the open bottom of the guide rail 53, so that the grip frame 57 is accommodated in the lengthwise direction of the guide rail 53. At the same time, the rear end of the drum shaft 2*a* is inserted into the bearing 54 mounted on the body frame 501.

The door 503, FIG. 6, may be implemented as a molding of synthetic resin and is openable away from the body frame 501 about hinges 507. An interrupter 506 is mounted on the bottom right portion of the door 503, as viewed in FIG. 6, and protrudes from the door 503 in such a manner as to face the body frame 501. It is to be noted that the position of the interrupter 506 relative to the door 503 is out of scale for the simplicity of illustration.

A door sensor or open/close sensing means 504 is mounted on the bottom left portion of the body frame 501 and responsive to the opening/closing of the door 503. The door sensor 504 is implemented by a transmission type optical sensor having a recess 505. When the door 503 is closed, the interrupter 506 enters the recess 505 of the door sensor 503 and interrupts the optical path of the sensor 503. As a result, the door sensor 503 turns on and senses the closed position of the door 503. When the interrupter 506 leaves the recess 505, the door sensor 503 turns off and senses the open position of the door 503. The door sensor 503 plays the role of closed position sensing means responsive to the closed position of the door 503 at the same time. A power switch 508 is mounted on the outer surface of the right wall of the body frame 501, as viewed in FIG. 3, and used to turn on and turn off power supply to the printer 500.

Figure 11:
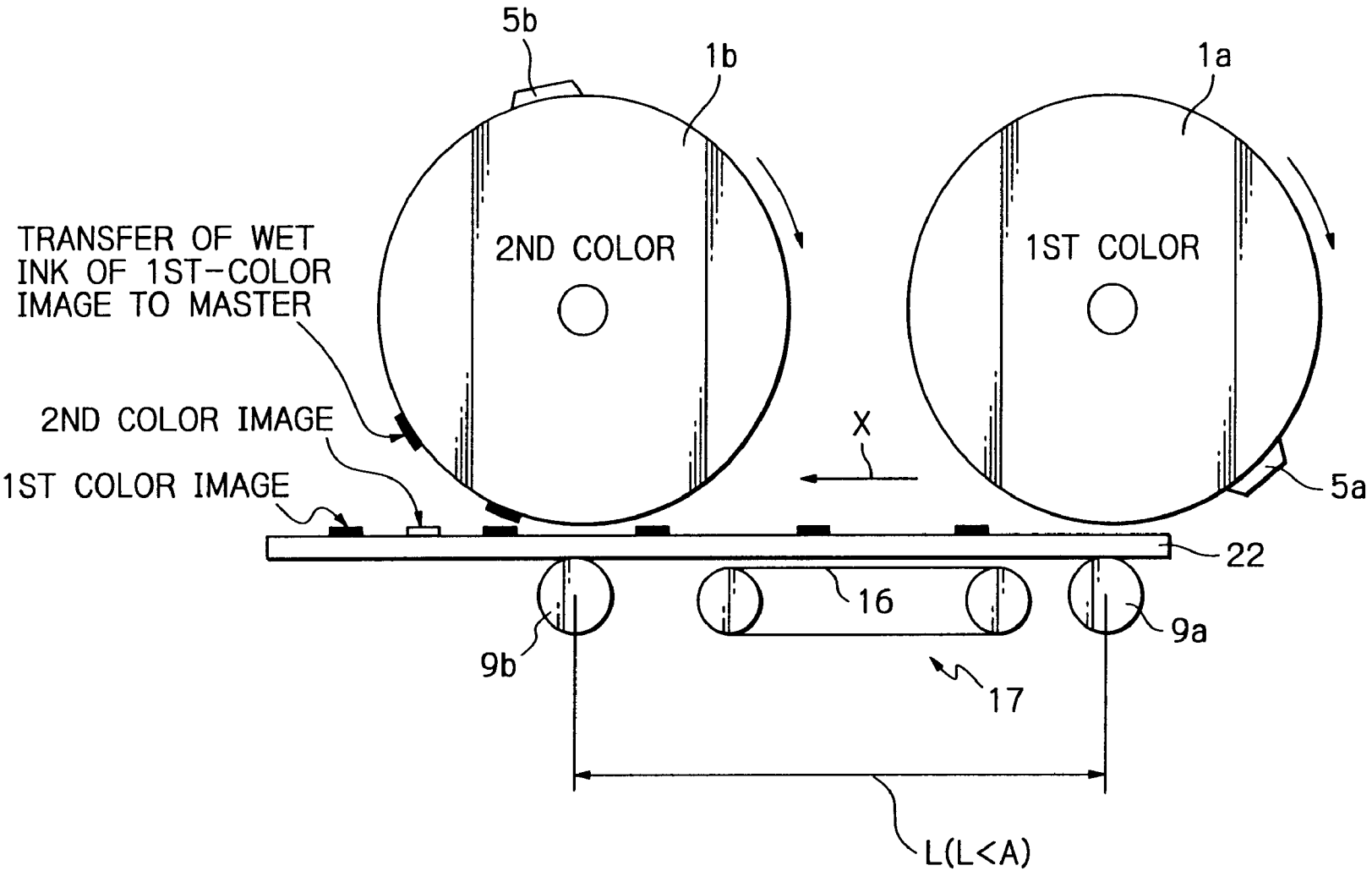
FIG. 11 is a view showing an initial phase difference provided between the first and second print drums.

The door sensor 504, playing the role of the open/close sensing means and closed position sensing means, may be replaced with the combination of a microswitch mounted on one of the door 503 and body frame 501 and an actuator mounted on the other of them for actuating the microswitch. Also, as shown in FIG. 11 of Laid-Open Publication No. 11-227309, use may be made of a door switch 96 implemented by a limit switch and a lever 97 that turns on and turns off the door switch 96.

As shown in FIG. 1, a first paper egress sensor or sensing means 74 adjoins the downstream portion of the print drum 1*a* in the direction of paper conveyance X when the drum unit 100*a* is set in the body frame 501. The paper egress sensor 74 is responsive to the roll-up of the paper sheet 22 and the egress error of the paper sheet 22. Likewise, a second paper egress sensor or sensing means 75 adjoins the downstream portion of the print drum 1*b* in the direction of paper conveyance X when the drum unit 100*b* is set in the body frame 501. The paper egress sensor 75 is also responsive to the roll-up of the paper sheet 22 and the egress error of the paper sheet 22.

The first and second paper egress sensors 74 and 75 are reflection type optical sensors similar in configuration to a roll-up sensor 50 shown in FIG. 6 of Laid-Open Publication No. 11-151852. The sensor 74 is positioned beneath a gap between a plurality of elements constituting the belt 16 in combination. Likewise, the sensor 75 is positioned beneath a gap between a plurality of elements constituting the belt 40 in combination.

As shown in FIG. 2, the drum drive means 80 includes drive transmitting means 82 in addition to the main motor or single drive source 81, which drives the print drums 1*a* and 1*b*. The drive transmitting means 82 includes the previously stated mount/dismount drive sections 95*a* and 95*b* that respectively connect the print drums 1*a* and 1*b* in a rotatable state. More specifically, the drive transmitting means 82 transfers the rotation of the main motor 81 to the print drums 1*a* and 1*b* via the mount/dismount drive sections 95*a* and 95*b*, respectively.

The main motor 81 is implemented by a DC motor and provided with conventional braking means. The main motor 81 is fixedly mounted between the rear plate 501A and an auxiliary plate 501B parallel to the rear plate 501A. In FIG. 2, the main motor 81 is shown as being positioned in a direction opposite to the above direction for the simplicity of illustration. The output shaft of the main motor 81 is rotatably supported by the rear plate 501A via a bearing not shown.

The main motor 81 has the following functions in addition to the function described above. When the drum unit 100*a* or 100*b* is to be dismounted from the body frame 501, the main motor 81 causes the print drum 1*a* or 1*b* of the drum unit to rotate via the mount/dismount drive section 95*a* or 95*b*. Also, when the drum unit 100*a* or 100*b* is to be mounted to the body frame 501, the main motor 81 causes the mount/dismount drive section 95*a* or 95*b* to rotate so as to rotate the print drum 1*a* or 1*b* of the drum unit.

Figure 4A:
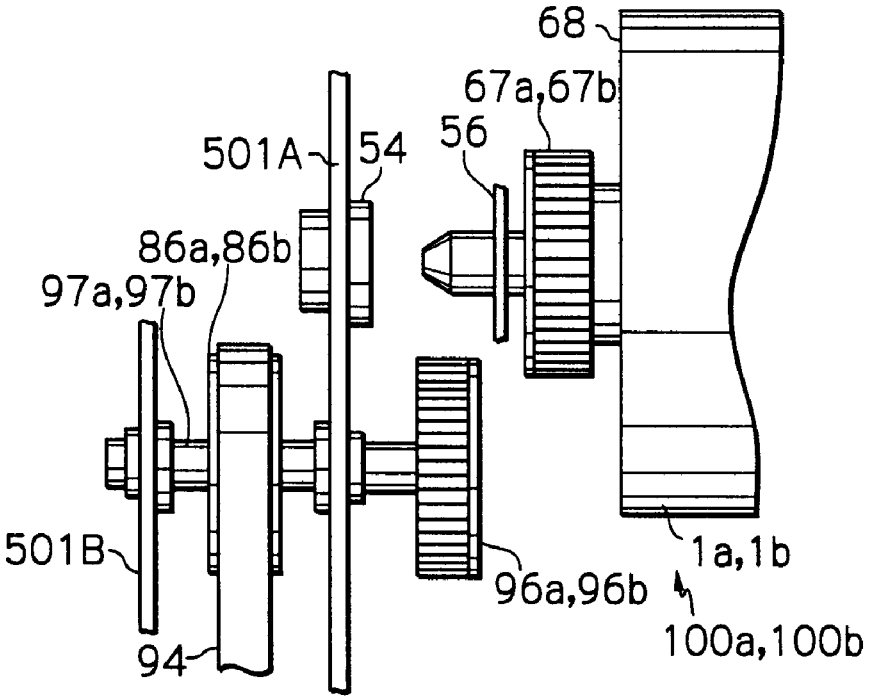
FIG. 4A is a fragmentary side elevation showing a drive gear included in a mount/dismount drive section and a drum gear included in the drum unit not brought into mesh with each other.
Figure 4B:
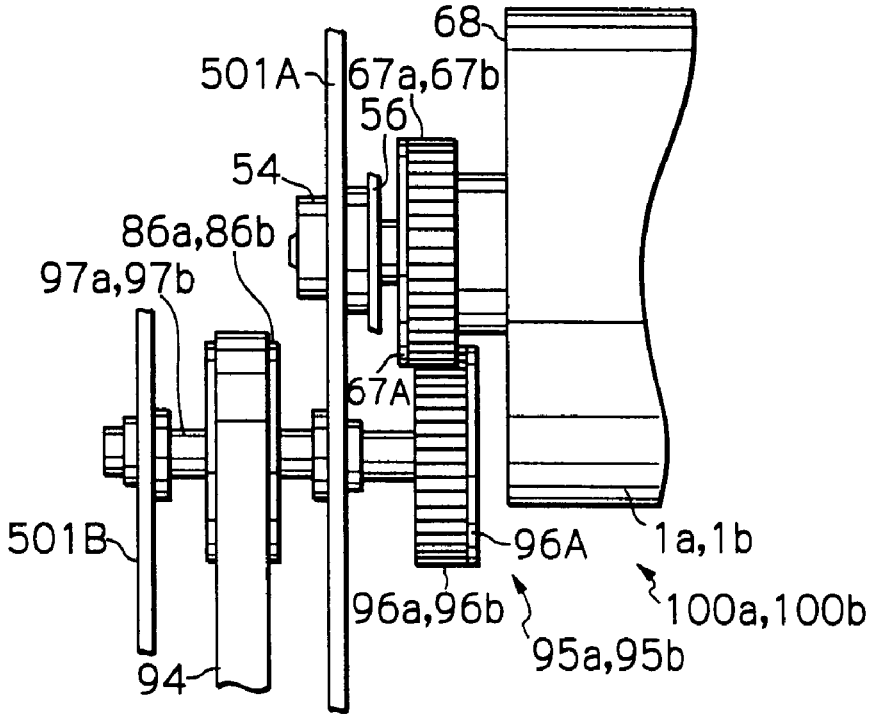
FIG. 4B is a view similar to FIG. 4A, showing the drive gear and drum gear brought into mesh with each other.

As shown in FIGS. 4A, 4B and 5, the mount/dismount drive section 95*a* assigned to the print drum 1*a* includes the previously mentioned drum gear 67*a*, which is mounted on the print drum 1*a*, and a drive gear 96*a* capable of meshing with the drum gear 67*a* only in a particular phase. Specifically, a disk-like flange 67A is formed on the edge of the drum gear 67*a* opposite to the edge adjoining the print drum 1*a*. Tooth-shaped notches 67B are formed in part of the flange 67A. On the other hand, a disk-like flange 96A is formed on the edge of the drive gear 96*a* facing the print drum 1*a*. Tooth-shaped notches 96B are formed in part of the flange 96A. The drum gear 67*a* and drive gear 96*a* can therefore mesh with each other only when their notches 67B and 96B meet each other. The notches 67B and 96B are so positioned as to face each other only when the print drum 1*a* reaches a preselected phase in which the damper 5*a* is positioned substantially at the bottom of the drum 1*a*, as shown in FIG. 9. This is also true with a drum gear 67*b* mounted on the print drum 1*b* and a drive gear 96*b* associated therewith; notches 67B and 96B are so positioned as to face each other only when the print drum 1*b* reaches a preselected phase in which the damper 5*b* is positioned substantially at the bottom of the drum 1*b*, as shown in FIG. 10.

In the above configuration, the mount/dismount drive section 95*a* is connected to the print drum 1*a*, which is to be mounted, and the drum drive means 80 when the drum 1*a* is brought to the preselected phase. At this position for mounting the print drum 1*a*, the mount/dismount drive section 95*a* can be brought to a stop. Likewise, the mount/dismount drive section 95*b* is connected to the print drum 1*b*, which is to be mounted, and the drum drive means 80 when the drum 1*b* is brought to the preselected phase. At this position for mounting the print drum 1*b*, the mount/dismount drive section 95*b* can be brought to a stop. The preselected phases of the print drums 1*a* and 1*b* will be referred to as mount/dismount positions hereinafter.

Alternative mount/dismount drive means applicable to the illustrative embodiment are as follows. Laid-Open Publication No. 11-184842, for example, proposes the combination of pins studded on the end walls of the print drums 1*a* and 1*b* and holes formed in the mount/dismount drive sections of the drum drive means 80 and each being capable of mating with one of the pins. If desired, use may be made of electric connecting means that selectively sets up connection in a particular phase in the direction of rotation of each print drum with an electrically generated force.

The drive gear 96*a* assigned to the print drum 1*a* is mounted on one end of a drive shaft 97*a* rotatably supported by the rear plate 501A and auxiliary plate 501B via bearings. A drum pulley 86*a* is mounted on the other end of the drive shaft 97*a*. Likewise, a drive gear 96*b* assigned to the print drum 1*b* is mounted on one end of a drive shaft 97*b* rotatably supported by the rear plate 501A and auxiliary plate 501B via bearings. A drum pulley 86*b* is mounted on the other end of the drive shaft 97*b*.

As shown in FIGS. 2, 4A and 4B, the drive transmitting means 82 includes a main drive gear 84 mounted on the output shaft of the main motor 81. An idle gear 85 held in mesh with the main drive gear 84 and drive gear 96*a*. The drive gear 96*a*, capable of selectively meshing with the drum gear 67*a*, is held in mesh with the idle gear 85. The drum pulley 86*a* is mounted on the drive shaft 97*a* together with the drive gear 96*a*. The drive gear 96*b* is capable of selectively meshing with the drum gear 67*b*. The drum pulley 86*b* is mounted on the drive shaft 97*b* together with the drive gear 96*b*. Top-bottom shifting means (83), which will be described later, includes rotation transmitting means 83A. A belt 94 is passed over pulleys included in the rotation transmitting means 83A as well as over the drum pulleys 86*a* and 86*b*.

Only part of top-bottom shift adjusting means including the up-down shifting means (83) is illustrated in order to clearly indicate the configurations unique to the drive transmitting means 82 and rotation transmitting means 82. The top-bottom shift adjusting means may have a configuration similar to first top-bottom shift adjusting means 212 shown in FIGS. 13 through 16 of Laid-Open Publication No. 11-138961. The top-bottom shifting means 83 may have a configuration similar to second top-bottom shifting means 245 also shown in FIGS. 13 through 16 of the above document. Specifically, the top-bottom shift adjusting means causes a print drum 1*b* located at the downstream side in the direction of paper conveyance X to adjust, only relative to a print drum 1*a* located at the upstream side, the shift of the top-bottom position of an image to be printed on the paper sheet 22. The downstream print drum 1*b* and upstream print drum 1*a*are respectively similar in configuration to the print drums 1*b* and 1*a* of the illustrative embodiment.

Assume that the print drum 1*a* is set in the body frame 501 with the drum gear 67*a* thereof meshing with the drive gear 96*a*, and that the main motor 81 is out of rotation and exerts its load on the print drum 1*a*. Then, when the top-bottom shifting means 83 is operated, it causes only the print drum 1*b* to rotate by a phase corresponding to a required shift of the top-bottom position of an image.

The rotation transmitting means 83A includes the drum pulleys 86*a* and 86*b*. An upper shift pulley 87 and a lower shift pulley 88 each are rotatably mounted on a respective shaft studded on a slider arm not shown. Four stationary pulleys 90, 91, 92 and 93 are arranged at opposite sides of the slider arm, and each is rotatably mounted on one of four shafts 89 studded on the rear plate 501A. The belt 94 is passed over the drum pulleys 86*a* and 86*b* and shift pulleys 87 and 88 and squeezed by the stationary pulleys 90 through 93 in a configuration shown in FIG. 2. The belt 94 and pulleys 86*a*, 86*b*, 87 and 88 are toothed.

The drum units 100*a* and 100*b* each include a device, not shown, for fixing the print drum 1*a* or 1*b* thereof at the mount/dismount position, at which the damper 5*a* or 5*b* is positioned substantially at the bottom, when the drum unit is to be pulled out of the body frame 501. The drum units 100*a* and 100*b* can therefore be inserted into the body frame 501 in the same position as when they are pulled out. The knob mentioned earlier includes an unlock lever, not shown, for mechanically unlocking the drum unit 100*a* from the body frame 501 when the operator grips the knob. Further, the drum unit 100*a* includes locking means for mechanically locking the drum unit 100*a* to an engaging portion included in the body frame 501 when the drum unit 100*a* is fully set in the body frame 501. The locking means may have a configuration shown in FIG. 5 of Laid-Open Publication No. 8-39916 by way of example. This implements a double lock structure together with the mounting/dismounting and locking structure available with the gears of the mount/dismount drive sections 95*a* and 95*b*, promoting safe, sure manual operation.

The configuration of the drum units 100*a* and 100*b* and that of the mounting/dismounting means 50*a* and 50*b* shown and described are only illustrative. Japanese Patent Laid-Open Publication No. 10-109470, for example, shows in FIG. 5 a drum unit 10 including a drum stopper mechanism 20 and means for detachably supporting the drum unit 10.

Reference will be made to FIGS. 9 through 11 for describing the preconditions of the present invention in order to facilitate the understanding of the illustrative embodiment. Briefly, the preconditions are that the distance between the print drums 1*a* and 1*b* is shorter than the circumferential length of each print drum, and that an initial phase difference is provided between the print drums 1*a* and 1*b*.

As shown in FIG. 11, assume that the print drums 1*a* and 1*b* each have a circumferential length A, and that the drums 1*a* and 1*b* are spaced from each other by a distance L. In FIG. 11, solid rectangles and an outline rectangle are respectively representative of an image of a first color and an image of a second color sequentially printed on the paper sheet 22. While the print drum 1*a* and press roller 9*a* press the paper sheet 22 therebetween, the print drum 1*a* in clockwise rotation conveys the paper sheet 22. The conveyor 17 conveys the paper sheet 22 to the print drum 1*b* at a speed equal to the peripheral speed of the print drum 1*a*. In this case, the prerequisite is that the images have the same reference position at both of the print drums 1*a* and 1*b*. It is therefore necessary that the phase of the print drum 1*b* in the direction of rotation be delayed by the distance L relative to the phase of the print drum 1*a*.

For example, as shown in FIG. 9, assume that the mount/dismount position of the print drum 1*a* (preselected phase in the direction of rotation) corresponds to a reference angle of 0° (mechanical origin) at which the damper 5*a* is positioned substantially at the bottom. Further, assume that the paper sheet 22 is conveyed under the above-described conditions, that for a compact configuration the distance L is not equal to the circumferential length A and is shorter than the length A, and that the distance L and length A are 240 mm and 180π (565) mm, respectively. Then, the phase of the print drum 1*b* must be delayed by an angle θb of 360× (240/565), i.e., nearly 153° (delay angle) relative to the phase of the print drum 1*a*.

On the other hand, as shown in FIG. 10, assume that the mount/dismount position of the print drum 1*b* (preselected phase in the direction of rotation) corresponds to a reference angle of 0° (mechanical origin) at which the damper 5*b* is positioned substantially at the bottom. Further, assume that that the paper sheet 22 is conveyed under the above described conditions, that the distance L and length A have the above described relation for a compact configuration, and that the distance L and length A are 150 mm and 360 mm, respectively. Then, the phase of the print drum 1*a* must be delayed by an angle θ a of 360× (240/565), i.e., nearly 153° (advance angle) relative to the phase of the print drum 1*b*.

By examining a relation between the print drums 1*a* and 1*b*, shown in FIGS. 9 and 10, and the mount/dismount drive sections 95*a* and 95*b* as to mounting/dismounting, it will be seen that the print drum 1*a* or 1*b* can be mounted or dismounted only when the mount/dismount position of the drum coincides with the mechanical origin of 0° of the printer body. That is, if the distance L is not equal to the length A, the drums 1*a* and 1*b* cannot be mounted or dismounted at the same time. In the condition shown in FIG. 9, only the print drum 1*a* coincident with the mechanical origin of 0° can be mounted or dismounted. In the condition shown in FIG. 10, only the print drum 1*b* can be mounted or dismounted because the advance angle or phase difference of the print drum 1*a* relative to the print drum 1*b* is about 153°.

In the illustrative embodiment, the distance L is not equal to the length A and is smaller than A while the distance L and length A are 240 mm and 180π (565) mm, respectively. Therefore, as shown in FIGS. 1, 9 and 10, the phase difference between the print drums 1*a* and 1*b* is about 153° in terms of the positions of the dampers 5*a* and 5*b*.

Why the above phase difference is selected will be described on the assumption that the masters 33*a* and 33*b* wrapped around the print drums 1*a* and 1*b*, respectively, are identical in image size, and that solid images are formed in the masters 33*a* and 33*b*. The print drums 1*a* and 1*b* are interconnected in such a manner as to rotate at the same peripheral speed. In addition, the path between the print positions assigned to the print drums 1*a* and 1*b* has a certain length. Obviously therefore, the print drum 1*b* should be provided with an initial phase difference corresponding to the length of the above path. Otherwise, the entire contour of the solid image would not be transferred from the print drum 1*b* to the paper sheet 22 in accurate register with the solid image transferred to the same from the print drum 1*a* in the direction of paper conveyance X.

It will be seen from the above that the mount/dismount drive sections 95*a* and 95*b* cannot be brought to the positions corresponding to the mount/dismount positions of the print drums 1*a* and 1*b* at the same time. Stated another way, the print drums 1*a* and 1*b* cannot be brought to the mount/dismount positions at the same time. Therefore, the illustrative embodiment is capable of conditioning only one of the mount/dismount drive sections 95*a* 95*b* for the mounting/dismounting of the associated print drums 1*a* and 1*b* simply by controlling a single main motor 81 via the drive transmitting means 82, which includes the rotation transmitting means 83A. This obviates the need for the sophisticated top-bottom shift adjusting means including the top-bottom shifting means and taught in Laid-Open Publication No. 11-138961.

The illustrative embodiment uses the rotation transmitting means 83A of the top-bottom shifting means 83, as stated earlier. Assume that when the print drum 1*b* is mounted to or dismounted from the body frame 501, the top-bottom shift adjusting means, for example, is operated to shift the print drum 1*b* from the initial phase difference of about 153° between the print drums 1*a* and 1*b*. Then, in response to a command output from a CPU (Central Processing Unit 201) (see FIG. 8), the top-bottom shifting means 83 automatically controls the angular position (phase) of the print drum 1*b* in such a manner as to restore the initial phase difference of about 153°.

As shown in FIG. 2, interrupters 103*a* and 103*b* protrude from one end of the drum pulleys 86*a* and 86*b*, respectively. The interrupters 103*a* and 103*b* are respectively responsive to the positions of the mount/dismount drive sections 95*a* and 95*b* corresponding to the mount/dismount positions of the print drums 1*a*and 1*b*. Mount/dismount position sensors 104*a* and 104*b* are mounted on the rear plate 501A in the vicinity of the portions of the drum pulleys 86*a* and 86*b* where the interrupters 103 and 103*b* are mounted. When the interrupters 103*a* and 103*b* respectively meet the sensors 104*a* and 104*b*, the sensors 104*a* and 104*b* determine that the mount/dismount drive sections 95*a* and 95*b*, respectively, have reached the above positions.

Interrupters, not shown, are also mounted on the ends of the drum pulleys 86*a* and 86*b* at positions different from the interrupters 103 and 103*b*. These interrupters each is responsive to the home position of one of the mount/dismount drive sections 95*a* and 95*b* corresponding to the home position of the associated print drum 1*a*or 1*b*. Home position sensors 70*a* and 70*b* are mounted on the rear plate 501A in the vicinity of the portions of the drum pulleys 86*a* and 86*b*, respectively, where the above interrupters are positioned. The home position sensors 70*a* and 70*b* are implemented by transmission type optical sensors.

Further, an encoder sensor 73 (see FIG. 8) is mounted on the end of the drum pulley 86*a* for sensing the rotation speed (peripheral speed) of the print drums 1*a* and 1*b* in cooperation with a photoencoder not shown. The encoder sensor 73 is implemented by a transmission type optical sensor while the photoencoder is implemented by, e.g., a slit disk.

In the illustrative embodiment, the home position sensors 70*a* and 70*b* play the role of home position sensing means responsive to the home positions of the print drums 1*a* and 1*b*, respectively. Laid-Open Publication No. 11-138961, for example, shows in FIG. 3 alternative home position sensing means made up of home position sensors 70*a* and 70*b* responsive to the home positions of print drums 1*a* and 1*b*, respectively, and interrupters 71*a* and 71*b*. The interrupters 71*a* and 71*b* respectively protrude from the rear end plates 68 of the print drums 1*a* and 1*b* and cooperate with the home position sensors 70*a* and 70*b*.

Because the illustrative embodiment includes the home position sensors 70*a* and 70*b*, the encoder sensor 73 is not essential. Assume that the home position sensors 70*a* and 70*b* are absent. Then, the CPU 201, FIG. 8 calculates the absolute rotation angles of the print drums 1*a* and 1*b* from the mechanical origin on the basis of the outputs of the mount/dismount position sensors 104*a* and 104*b* and the output of the encoder sensor 73. The absolute rotation angles are representative of the angular positions of the print drums 1*a* and 1*b* and those of the mount/dismount drive sections 95*a* and 95*b*. In this manner, the home positions of the print drums 1*a* and 1*b* can be determined even if the home position sensors 70*a* and 70*b* are absent.

The gear and belt scheme implementing the drive transmitting means 82 may be replaced only with gears. For the main motor 81, use may be made of a stepping motor or similar pulse-driven motor in place of the DC motor. In such a case, the angular positions of the print drums 1*a* and 1*b* and those of the mount/dismount drive sections 95*a* and 95*b* can be determined without resorting to the encoder sensor 73. Further, because the print drum 1*b* is driven by belt connection, only one of the home position sensors 70*a* and 70*b* suffices if, e.g., the elongation of the belt that effects sensing accuracy is not questionable.

The illustrative embodiment is, of course, practicable with three or more print drums so long as the distance L is not equal to the length A and is smaller than the length A for the compact configuration of the printer.

Figure 8:
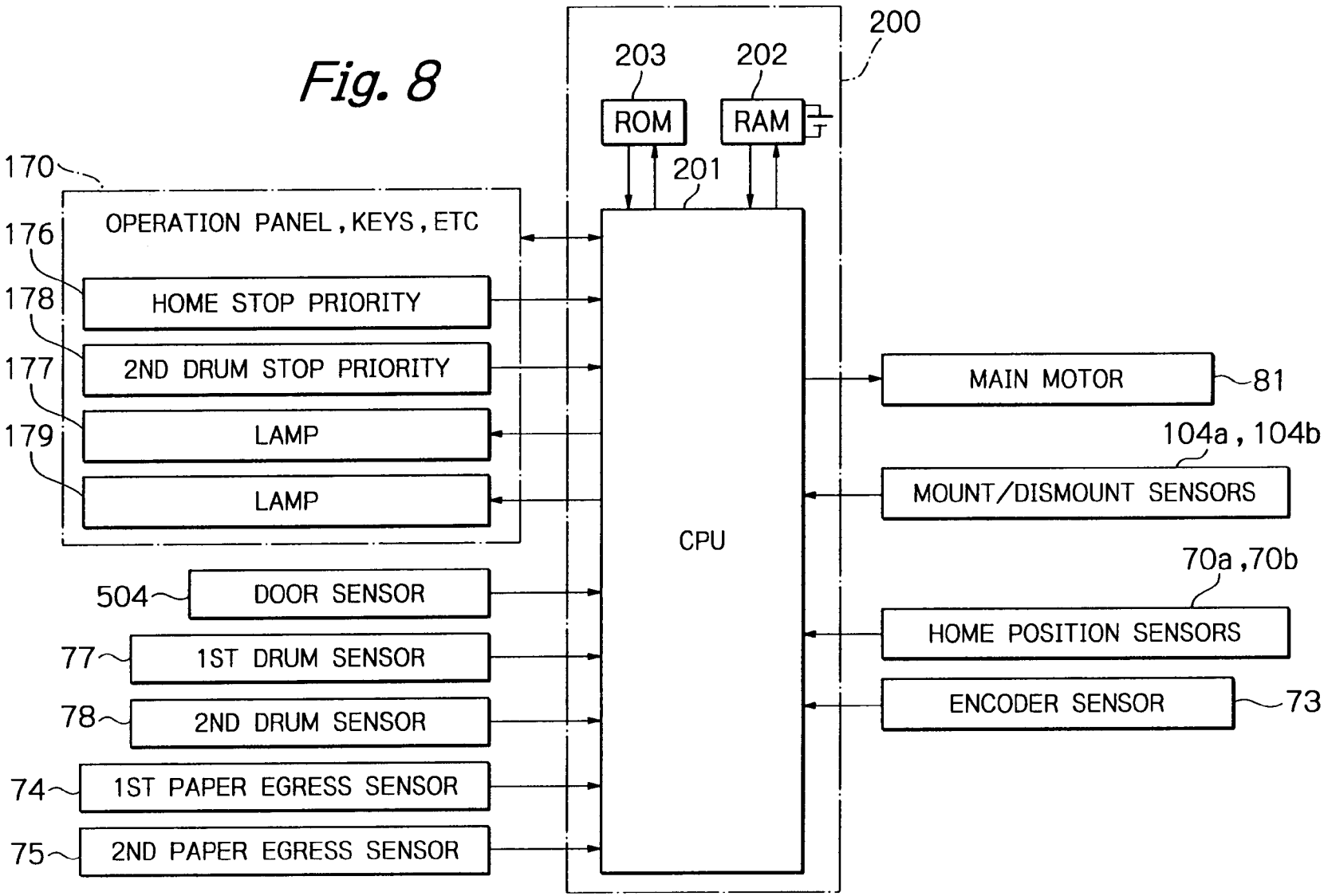
FIG. 8 is a block diagram schematically showing a control system further included in the printer of FIG. 1.

Referring again to FIG. 3, a connector, not shown, is mounted on the rear plate 501A and similar in configuration to a connector shown in FIG. 4 of Laid-Open Publication No. 11-138961. A connector engageable with the above connector is mounted on the outer periphery of the rear frame 56 of the drum unit 100*a*. The connector on the rear plate 501A is electrically connected to a power source, not shown, and the controller 200, FIG. 8. The connector on the drum unit 100*a* is connected to the ink sensing means and ink pump mentioned earlier. When the drum unit 100*a* is inserted into the body frame 501, the connector on the drum unit 100*a* is connected to the connector on the rear plate 501A. In this condition, power is fed from the power source to the drum unit 100*a* while various signals are interchanged between the controller 200 and the drum unit 100*a*. At the same time, the presence of the print drum 1*a* is electrically sensed. This is also true with the other drum unit 100*b*. In this sense, the connectors on the drum units 100*a* and 100*b* and connector on the rear plate 501A constitute drum sensing means respectively responsive to the print drums 1*a* and 1*b* mounted to the body frame 501. In FIG. 8, such drum sensing means are represented by a first and a second drum sensor 77 and 78 respectively responsive to the print drum or first print drum 1*a* and the print drum or second print drum 1*b*.

Laid-Open Publication No. 11-227309, for example shows in FIG. 6 another drum sensing means applicable to the illustrative embodiment. The drum sensing means taught in this document is a microswitch 70 engageable with a stop 41 included in a drum mounting/dismounting and locking mechanism 24. The microswitch 70 is turned on and turned off via a switch lever 70*a* included in an apparatus body 1, which is shown in FIG. 7 of the same document.

Figure 7:
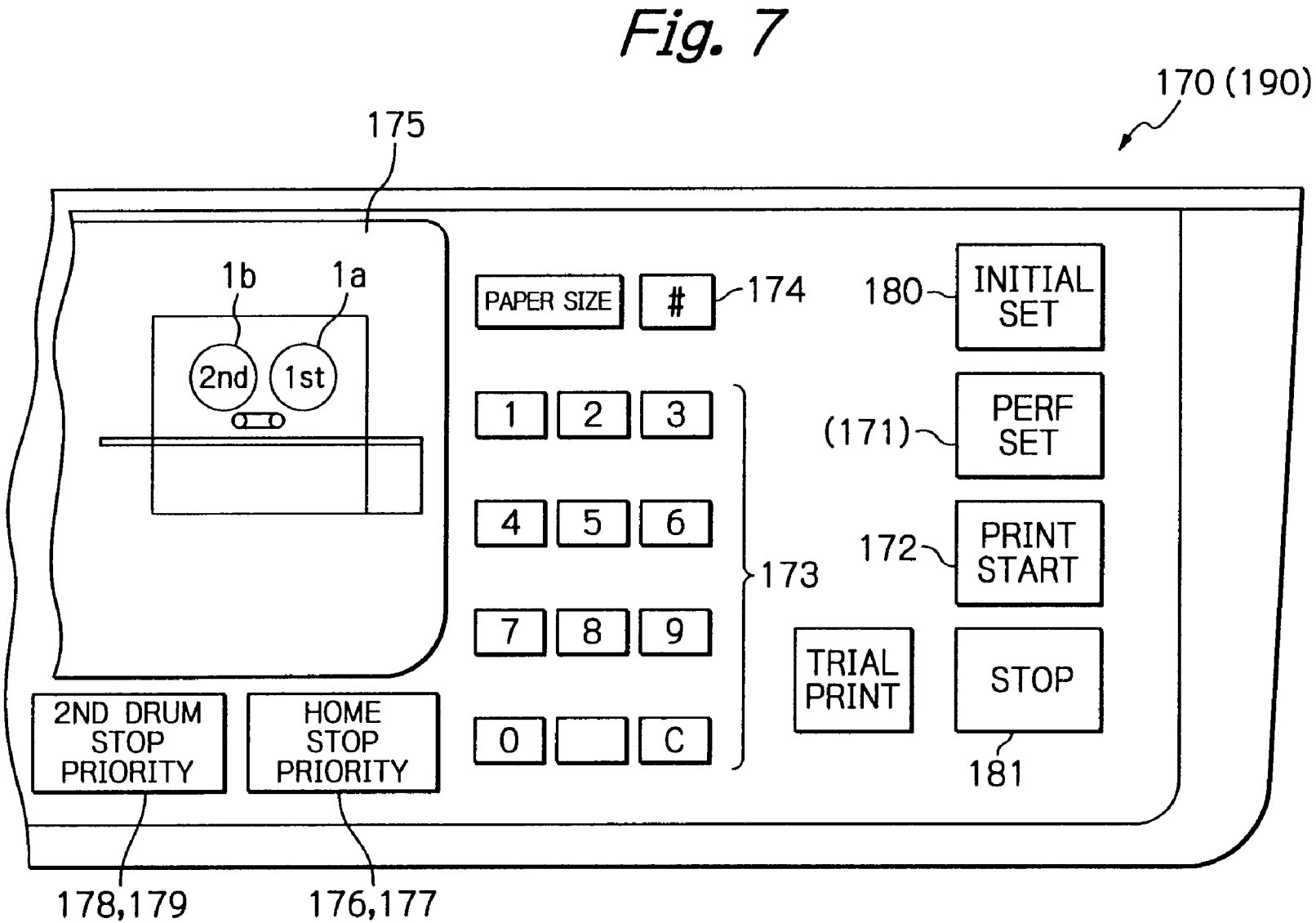
FIG. 7 is a plan view showing a specific configuration of an operation panel included in the printer of FIG. 1.

Reference will be made to FIG. 7 for describing a specific configuration of the operation panel 170. As shown, the operation panel 170 includes various keys for operating the printer 500 and various indicators and a display for displaying the operation conditions of the printer 500. Specifically, numeral keys 173 allow the operator of the printer 500 to set or input, e.g., a desired number of printings. A print start key 172 is operated to start a procedure for outputting the desired number of printings and beginning with paper feed and ending with paper discharge. An enter key 174 is used to enter, e.g., settings relating to various modes which will be described specifically later.

A home stop priority key or home stop priority setting means 176 is pressed to give priority to a home stop priority mode, neglecting a stop position order assigned to the print drums 1*a* and 1*b* beforehand, as will be described specifically later. The home stop priority mode causes the print drums 1*a* and 1*b* to stop at the respective home positions. A second drum stop priority key or specified drum stop priority setting means 178 is used to give priority to a specified drum stop priority mode, neglecting the stop position order set beforehand. The specified drum stop priority mode causes either one of the print drums 1*a* and 1*b* (print drum 1*b* in the illustrative embodiment) to stop at the mount/dismount position or preselected phase. An initial set key 180 allows the operator to set initial operations relating to various modes before starting the printer 500, as needed. A stop key 181 may be pressed to interrupt the paper feed, print and paper discharge procedure.

In FIG. 7, the parenthesized reference numeral (190) designates an operation panel not used in the illustrative embodiment, but used in a modification of the illustrative embodiment to be described later. Also, the parenthesized reference numeral (171) designates a perforation start key not used in the illustrative embodiment, but used in the modification of the same. The perforation start key or operation starting means (171) is pressed to start a procedure consisting of the discharge of used masters, the perforation of the stencil, the feed of the resulting masters, trial printing, and the discharge of a paper sheet.

Lamps 177 and 179 are respectively associated with the home stop priority key 176 and second drum stop priority key 178, and each turns on when the associated mode is set up. An LCD (Liquid Crystal Display) 175 displays information representative of the operator's manipulation, messages including an alarm message, modes and functions selected, and information for guiding the operator.

The lamps 177 and 179 are implemented by LEDs (Light Emitting Diodes). The lamp 177 is positioned inside, or below, the home stop priority key 176. When the operator sequentially presses the initial set key 180, home stop priority key 176 and enter key 174 in this order, a home stop priority (ON) signal is generated and causes the lamp 177 to turn on, showing the operator that the home stop priority mode is set up. In this sense, the initial set key 180, home stop priority key 176 and enter key 174 constitute home stop priority setting means. Likewise, the lamp 179 is positioned inside, or below, the second drum stop priority key 178. When the operator sequentially presses the initial set key 180, second drum stop priority key 178 and enter key 174 in this order, a second drum stop priority (ON) signal is generated and causes the lamp 179 to turn on, showing the operator that the second drum stop priority mode is set up.

In this sense, the initial set key 180, second drum stop priority key 178 and enter key 174 constitute specified drum stop priority setting means.

The home stop priority key 176 and second drum stop priority key 178 allow the operator to initially set operations relating to a desired mode before starting the printer 500 in cooperation with the initial key 180 and enter key 174. A mode cancel key, not shown, is also arranged on the operation panel 170 for allowing the operator to cancel the mode set up.

An LCD driver, not shown, causes the LCD 175 to display the rotation of the print drums 1*a* and 1*b* to their mount/dismount positions in the form of graphic or text information. In addition, the LCD 175 displays, based on the outputs of the first and second paper egress sensors 74 and 75, the print drum 1*a* or 1*b* where defective paper egress has occurred, while alerting the operator to the defective paper egress.

Various indicating means for indicating the operating conditions of the printer 500 may be arranged on the body frame 501 around the openings 501*a* and 501*b* or on the operation panel 170, if desired. Such indicating means each may be assigned to one of the drum units 100*a* and 100*b* in order to show the operator whether or not the drum unit 100*a* or 100*b* can be mounted to dismounted from the body frame 501. The operator can confirm such displaying means located at easy-to-see positions and can therefore easily manipulate the printer 500. The function of the displaying means, which shows whether or not the operator is allowed to mount of dismount the drum units 100*a* and 100*b*, may be assigned to the LCD 175.

Referring to FIG. 8, the controller 200 includes a microcomputer including, in addition to the CPU 201, a RAM (Random Access Memory) 202, a ROM (Read Only Memory) 203, and I/O (Input/Output) ports not shown. These constituents of the controller 200 are interconnected by, e.g., a signal bus not shown. The RAM 202 is provided with a backup power source. It is to be noted that FIG. 8 shows only essential control arrangements for the clarity of description and illustration.

The CPU 201 receives ON/OFF signals and data signals from the home position sensors 70*a* and 70*b*, encoder sensor 73, first and second paper egress sensors 74 and 75, first and second drum sensors 77 and 78, mount/dismount position sensors 104*a* and 104*b*, and door sensor 504. Also, the CPU 201 receives ON/OFF signals from the keys arranged on the operation panel 170 and including the home stop priority key 176 and second drum stop priority key 178. The CPU 201, in turn, sends various command signals to the lamps 177 and 179 arranged on the operation panel 170 while sending various command signals to the main motor 81.

Assume that the door sensor 504 turns on and outputs a close signal, and that the first or second drum sensor 77 or 78 turns off and outputs an absence signal indicative of the absence of the print drum 1*a* or 1*b*, respectively. In response, the CPU 201 (sometimes controller 200 hereinafter) controls the main motor 81 of the drum drive means 80 such that the mount/dismount drive section 95*a* or 95*b* assigned to the print drum 1*a* or 1*b*, respectively, is brought to the position corresponding to the mount/dismount position of the print drum. Subsequently, the mount/dismount position sensor 104*a* or 104*b* turns on and outputs a mount/dismount position signal. In response, the CPU 201 again controls the main motor 81 such that the drive section 95*a* or 95*b* stops at the above position. Let this control executed by the CPU 201 be referred to as a first function.

Assume that the drum sensors 77 and 78 turn on and output presence signals while the door sensor 504 outputs the close signal. In response, the controller 200 controls the main motor 81 such that the print drums 1*a* and 1*b* each rotate to the respective home position. When the home position sensors 70*a* and 70*b* turn on and output home position signals, the controller 200 again control the main motor 81 such that the print drums 1*a* and 1*b* stop at their home positions. This control will be referred to as a second function.

Assume that the door sensor 504 outputs the close signal, that the drum sensors 77 and 78 output the presence signals, and that a home stop priority (ON) signal output from, e.g., the home stop priority key 176. Then, the controller 200 controls the main motor 81 such that the print drums 1*a* and 1*b* rotate to their home positions. Subsequently, in response to the home position signals output from the home position sensors 70*a* and 70*b*, the controller 200 again controls the main motor 81 such that the print drums 1*a* and 1*b* stop at their home positions. This control will be referred to as a third function.

Assume that the door sensor 504 outputs the close signal, that the drum sensors 77 and 78 output the presence signals, and that the second drum stop priority key 178 outputs a second drum stop priority (ON) signal. In response, the controller 200 controls the main motor 81 such that the second print drum 1*b* specified rotates to its mount/dismount position. Subsequently, in response to a mount/dismount position (ON) signal output from the mount/dismount position sensor 104*b*, the controller 200 again controls the main motor 81 such that the second drum 1*b* stops at the mount/dismount position. This control will be referred to as a fourth function.

When the home stop priority key 176 outputs the home stop priority signal, the controller 200 causes the lamp 177 to turn on. This control will be referred to as a fifth function. Likewise, in response to the second drum stop priority signal output from the second drum drop priority key 178, the controller 200 causes the lamp 179 to turn on. This control will be referred to as a sixth function. Further, in response to the output of the door sensor 504 and the outputs of the drum sensors 77 and 78, the controller 200 so controls the LCD display 175 as to display corresponding information. This function will be referred to as a seventh function.

The ROM 203 stores data for controllably driving the main motor 81 and LCD 175 and a program for executing specific procedures that will be described with reference to FIGS. 12 and 13 later. Further, the ROM 203 stores a priority order as to the stop positions of the print drums 1*a* and 1*b* and those of the mount/dismount drive sections 95*a* and 95*b*. Specifically, in the illustrative embodiment, priority is given to the mounting/dismount position of the first print drum 1*a*. Therefore, the priority order is such that the drive section 95*a* assigned to the first print drum 1*a* is rotated to the position corresponding to the mount/dismount position, then the drive section assigned to the second print drum 1*b* is rotated to the position corresponding to the mount/dismount position, and then the drive sections 95*a* and 95*b* are rotated to the positions corresponding to the home positions of the print drums 1*a* and 1*b* in order to stop the drums 1*a* and 1*b* at the home positions. More specifically, priority is sequentially given to the mount/dismount position of the first print drum 1*a* (position of the drive section 95*a* corresponding thereto), the mount/dismount position of the second print drum 1*b* (position of the drive section 95*b* corresponding thereto), and the home positions of the print drums 1*a* and 1*b* (home positions of the drive sections 95*a* and 95*b*)in this order.

The RAM or storing means 202 temporarily stores the data signals output from the keys and sensors. Also, the RAM 202 stores program data for allowing, even after the power switch 508 has been turned off, the operation relating to the initially set home stop priority mode when the operator sequentially presses the initial set key 180, home stop priority key 176 and enter key 174. In addition, the RAM 202 stores program data for allowing, even after the turn-off of the power switch 508, the operation relating to the initially set second drum stop priority mode when the operator sequentially presses the initial set key 180, second drum stop priority key 178, and enter key 174. The RAM 202 with the backup power source may be replaced with, e.g., a flush memory having an equivalent function.

The stencil printer 500 will be operated, as follows. To better understand the operation unique to the illustrative embodiment, the paper feed, print and paper discharge procedure will be described first. After used masters 33*a* and 33*b* have been discharged, new masters 33*a* and 33*b* are wrapped around the print drums 1*a* and 1*b*, respectively. The print drums 1*a* and 1*b* with the new masters are mounted to the body frame 501. This initial condition is shown in FIG. 1. Specifically, the print drum 1*a* is caused to rotate to and stop at its home position where the damper 5*a* faces obliquely upward rightward. The print drum 1*b* is caused to rotate to and stop at its home position where the damper 5*b* faces obliquely upward leftward. In this manner, a preselected phase difference is initially provided between the print drums 1*a* and 1*b* when set in the body frame 501, as stated earlier.

When the operator turns on the power switch 508, information representative of the initially set conditions appear on the operation panel 170. At this stage, the lamps 177 and 179 do not turn on. The operator can therefore see that an ordinary print mode, as distinguished from the home stop priority mode or the second drum stop priority mode, is set. Subsequently, when the operator presses the print start key 172, the printer 500 starts a printing operation. Specifically, the tray 21 is raised to a position where the top of the paper stack 22 contacts the pickup roller 23. The paper feed motor 44 is energized to rotate the separator roller 24 and therefore the pickup roller 23, so that the pickup roller 23 pays out the top sheet 22 from the tray 21. The separator rollers 24 and 25 cooperate to separate the top sheet being paid out from the underlying paper sheets 22. The paper sheet 2 is conveyed toward the registration rollers 29 and 30 in the direction of paper conveyance X while being guided by the upper and lower guides 28 and 27. The leading edge of the paper sheet 22 abuts against the portion of the registration rollers 29 and 30 just short of the nip. The paper sheet 22 is therefore stopped by the registration rollers 29 and 30 with its leading edge portion bending upward.

The print drum 1*a* is caused to start rotating at a print speed. An ink distributor, not shown, feeds black ink to the ink well 1*a*between the ink roller 3*a* and the doctor roller 4*a*. The ink roller 3*a* and doctor roller 4*a* in rotation cause the ink to uniformly deposit on the ink roller 3*a* while kneading it. When the amount of ink existing in the ink well 1*a* becomes short, as sensed by the previously stated ink sensing means, the ink distributor replenishes the ink. The ink roller 3*a* rotates in the same direction as and in synchronism with the print drum 1*a*, feeding the ink to the inner periphery of the print drum 1*a*.

The registration motor 47 is energized to drive the registration rollers 29 and 30 at such a timing that the leading edge of the paper sheet 22 meets the leading edge of an image formed in the master 33*a* wrapped around the print drum 1*a*. When the leading edge of the paper sheet 22 arrives at the print position between the print drum 1*a* and the press roller 9*a*, the press roller 9*a* is angularly moved upward and pressed against the master 33*a* with the intermediary of the paper sheet 22. Consequently, the master 33*a* closely adheres to the outer periphery of the print drum 1*a* due to the viscosity of the ink oozed out via the porous portion, not shown, of the print drum 5 1*a*. Further, the ink is transferred from the print drum 1*a* to the paper sheet via a perforation pattern formed in the master 33*a*, forming an image of a first color, i.e., black.

When the leading edge of the paper sheet 22 carrying the black image approaches the edge of the air knife 7*a*, the air knife 7*a* is rotated about the shaft 8*a* toward the print drum 1*a* in synchronism with the rotation of the drum 1*a*. The air knife 7*a* then sends air under pressure so as to peel off the leading edge of the paper sheet 22 from the print drum 1*a*. The conveyor 17 conveys the paper sheet 22 so separated from the print drum 1*a* to the downstream side in the direction of paper conveyance X.

While the belt 16 turns counterclockwise, as indicated by an arrow in FIG. 1, the fan 18 sucks the paper sheet 22 onto the belt 16 by generating vacuum in the casing 19. This allows the belt 16 to surely convey the paper sheet 22 to the next printing device 32*b*.

The belt 16 is caused to move at a speed equal to or higher than the peripheral speed of the print drum 1*a*, as stated previously. However, the paper sheet 22 moves to the left, as viewed in FIG. 1, at a speed equal to the peripheral speed of the print drum 1*a* because the upstream portion of the paper sheet 2 is still nipped by the print drum 1*a* and press roller 9*a*. The paper sheet 22 is therefore conveyed under tension. In a strict sense, the belt 16 and paper sheet 22 slip on each other because the conveying speed of the belt 16 is higher than the moving speed of the paper sheet 22.

The print drum 1*b* assigned to a second color is caused to start rotating at the print speed in synchronism with the print drum 1*a*. An ink roller 3*b* disposed in the print drum 1*b* rotates in contact with the inner periphery of the drum 1*b*. As a result, red ink, i.e., ink of a second color is fed to the inner periphery of the print drum 1*b* via the same configuration as described in relation to the print drum la. A preselected phase difference is provided between the print drums 1*a* and 1*b* such that the reference position of the black image and that of a red image coincide on the paper sheet 22, as stated earlier.

The paper sheet 22 arrives at the print position between the print drum 1*b* and a press roller 9*b* included in the pressing device 32*b* at a preselected timing synchronous to the rotation of the print drum 1*b*. At this instant, the belt 16 is pulling the leading edge portion of the paper sheet 22 in the direction in which it turns. The press roller 9*b* is then angularly moved upward and pressed against the master 33*b* wrapped around the print drum 1*b* under the action of the tension spring 13*b*. As a result, the master 33*b* closely adheres to the outer periphery of the print drum 1*b* due to the viscosity of the red ink oozed out via the porous portion, not shown, of the drum 1*b*. Further, the red ink is transferred from the print drum 1*b* to the paper sheet 22 via a perforation pattern formed in the master 33*b*, forming an image of a second color, i.e., red over the black image.

The press roller 9*b* is released from the print drum 1*b* during printing so as not to interfere with the damper 5*b*, which protrudes from the outer periphery of the print drum 1*b*. However, before the leading edge of the paper sheet 22 enters the print position between the print drum 1*b* and the press roller 9*b*, the press roller 9*b* is pressed against the print drum 1*b*.

When the paper sheet 22 carrying the resulting bicolor image thereon approaches the air knife 7*b*, the air knife 7*b* is rotated about the shaft 8*b* toward the print drum 1*b* in synchronism with the rotation of the drum 1*b*. The air knife 7*b* then sends air under pressure to peel off the leading edge of the paper sheet 22 from the print drum 1*b*. The paper discharging device 35 conveys the paper sheet, or printing, 22 so separated from the print drum 1*b* to the tray 37 in the direction of paper conveyance X. The fans 34 and 36 and jump board 40A have the previously stated functions.

The procedure described so far is generally referred to as trial printing. After the trial printing, the press drums 9*a* and 9*b* are released from the print drums 1*a* and 1*b*, respectively, and retracted to the initial positions shown in FIG. 1.

Looking at the bicolor image formed on the paper sheet or trial printing 22, the operator confirms the quality and position of the image. If, e.g., the position of the image in the direction of paper conveyance X is inadequate, the operator may cause the previously stated top-bottom shift adjusting means 212 to shift the image. If the image is acceptable, the operator inputs a desired number of printings on the numeral keys 173 and then presses the print start key 172. In response, the paper feed, print and paper discharge procedure is repeated a number of times corresponding to the desired number of printings in exactly the same manner as during trial printing.

Figure 12:
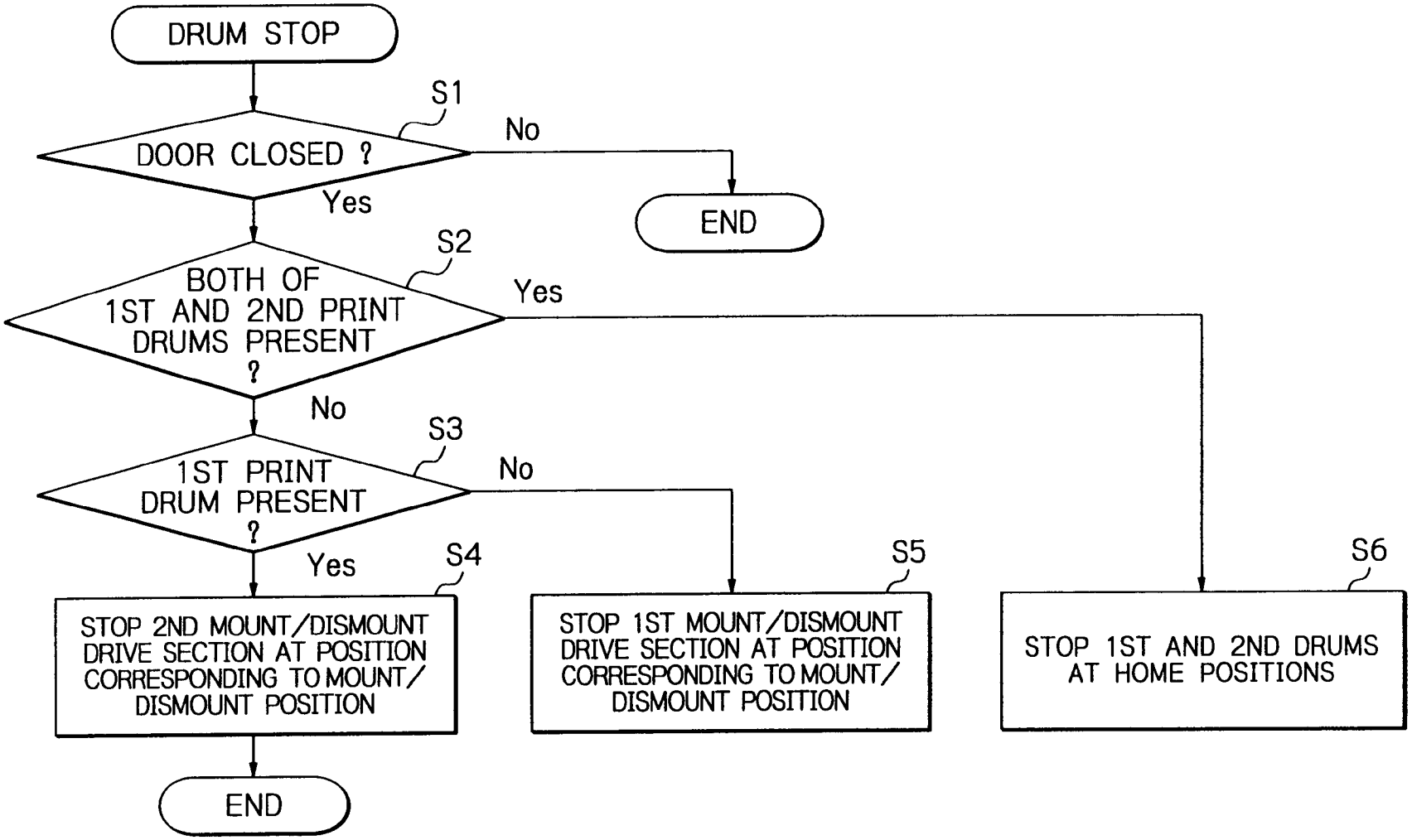
FIG. 12 is a flowchart demonstrating a first specific operation of the printer of FIG. 1.

FIG. 12 shows a first specific operation relating to drum stop processing available with the illustrative embodiment. The first specific operation is effected when, e.g., the drum units 100*a* and 100*b* are mounted and dismounted from the body frame 501 for the replacement of the colors of ink or the masters 33*a* and 33*b* or for a cleaning purpose. Also, assume that the paper sheet 22 adheres to the master 33*a* or 33*b* and rolls up together with the print drum 1*a*or 1*b* without being separated by the air knife 7*a* or 7*b*, or that the paper sheet 22 jams the path between the print drums 1*a* and 1*b*. Then, the first specific operation is effected when the drum unit 100*a* and/or the drum unit 100*b* is pulled out of the body frame 501 and then inserted into the body frame 501. The first specific operation makes it needless for the operator to press mount/dismount keys otherwise assigned to the print drums 1*a* and 1*b* every time any one of the above troubles occurs, and saves time. The first specific operation is implemented mainly by the first, second and seventh functions available with the controller 200.

Specifically, as shown in FIG. 12, the controller 200 determines whether or not the door 503 is closed on the basis of the output of the door sensor 504 (step S1). If the answer of the step S1 is positive (Yes), the controller 200 determines whether or not the first and second print drums 1*a* and 1*b* both are present in the body frame 501 on the basis of the outputs of the first and second drum sensors 77 and 78 (step S2). If the answer of the step S1 is negative (No), the controller 200 ends the drum stop processing.

If the answer of the step S2 is Yes, the controller 200 executes processing for stopping the print drums 1*a* and 1*b* at their home positions (step S6). Specifically, the controller 200 controls the main motor 81 such that the print drums 1*a* and 1*b* rotate to the respective home positions. The rotation of the main motor 81 is transferred to the print drums 1*a* and 1*b* via the drum drive means 80 and the mount/dismount drive sections 95*a* and 95*b* of the rotation transmitting means 83A. As soon as the print drums 1*a* and 1*b* reach the respective home positions shown in FIG. 1, the home position sensors 70*a* and 70*b* send home position signals to the controller 500. In response, the controller 200 controls the main motor 81 such that the print drums 1*a* and 1*b* stop at the respective home positions.

If the answer of the step S2 is No, meaning that one or both of the print drums 1*a* and 1*b* are absent in the body frame 501, the controller 200 determines whether or not the print drum 1*a* is present in the body frame 501 (step S3). Assume that the first and second drum sensors 77 and 78 respectively send an absence signal and a presence signal to the controller 200. In response, the controller 200 determines that the print drum 1*b* is present in the body frame 501, but the print drum 1*a* is absent and expected to be mounted to the body frame 501 (No, step S3). Then, the controller 200 executes a step S5.

In the step S5, the controller 200 controls the main motor 81 such that the mount/dismount drive section 95*a* assigned to the print drum 1*a* rotates to the position corresponding to the mount/dismount position of the print drum 1*a*. Again, the rotation of the main motor 81 is transferred to the mount/dismount drive sections 95*a* and 95*b*. The drive section 95*a* then rotates to the position shown in FIG. 9 where it is connectable to the print drum 1*a*. The mount/dismount position sensor 104*a* sends a mount/dismount position signal to the controller 200. In response, the controller 200 so controls the main motor 81 as to stop the drive section 95*a* at the position shown in FIG. 9.

In the step S5, the controller 200 additionally causes the LCD 175 to show the operator that the printer 500 is ready to receive the drum unit 100*a* (first drum 1*a*). The operator, watching the LCD 175, opens the door 503 and then inserts the drum unit 100*a* into the opening 501*a* via the mounting/dismounting means 50*a*. The drum unit 100*a* can be easily mounted to the body frame 501 because the mount/dismount drive section 95*a* is held stationary at the position corresponding to the mount/dismount position of the print drum 1*a*. The operator then closes the door 503.

On the other hand, assume that the drum sensors 77 and 78 respectively send a presence signal and an absence signal to the controller 200. Then, the controller 200 determines that the print drum 1*a* is present in the body frame 501, but the print drum 1*b* is absent and expected to be mounted to the body frame 501 (Yes, step S3). In this case, the controller 200 controls the main motor 81 such that the mount/dismount drive section 95*b* assigned to the print drum 1*b* rotates to the position corresponding to the mount/dismount position of the print drum 1*b* (step S4). Again, the rotation of the main motor 81 is transferred to the mount/dismount drive sections 95*a* and 95*b*. The drive section 95*b* rotates to the position shown in FIG. 10 corresponding to the mount/dismount position of the print drum 1*b*. The mount/dismount position sensor 104*b* sends a mount/dismount signal to the controller 200. In response, the controller 200 so controls the main motor 81 as to stop the drive section 95*b* at the above position.

In the step S4, the controller 200 additionally causes the LCD 175 to show the operator that the printer 500 is ready to receive the drum unit 100*b* (second drum 1*b*). The operator, watching the LCD 175, opens the door 503 and then inserts the drum unit 100*b* into the opening 501*b* via the mounting/dismounting means 50*b*. The drum unit 100*b* can be easily mounted to the body frame 501 because the mount/dismount drive section 95*b* is held stationary at the position corresponding to the mount/dismount position of the print drum 1*b*. The operator then closes the door 503.

Assume that the answer of the step S2 is No and that the print drums 1*a* and 1*b* both are absent in the body frame 501 and expected to be mounted to the body frame 501. Then, the controller 200 causes the mount/dismount drive section 95*a* assigned to the print drum 1*a*to rotate to and stop at the position corresponding to the mount/dismount position of the drum 1*a* in accordance with the priority order. This is because the mount/dismount drive sections 95*a* and 95*b* cannot be brought to the respective mount/dismount positions at the same time, as stated earlier.

When the door 503 is open, as determined in the step S1, the controller 200 may cause the LCD 175 to display an alarm message in response to the output of the door sensor 504 for a safety purpose. Also, in response to the absence signal output from the drum sensor 77, the controller 200 may cause, in the step S3, the LEDs to show the operator that the print drum 1*a* should be mounted. Further, in response to the mount/dismount position output from the sensor 104*a*, the controller 200 may cause, in the step S5, the LEDs to show the operator that the printer 500 is ready to receive the print drum 1*a*. This is also true with a second specific operation to be described with reference to FIG. 13 hereinafter.

Figure 13:
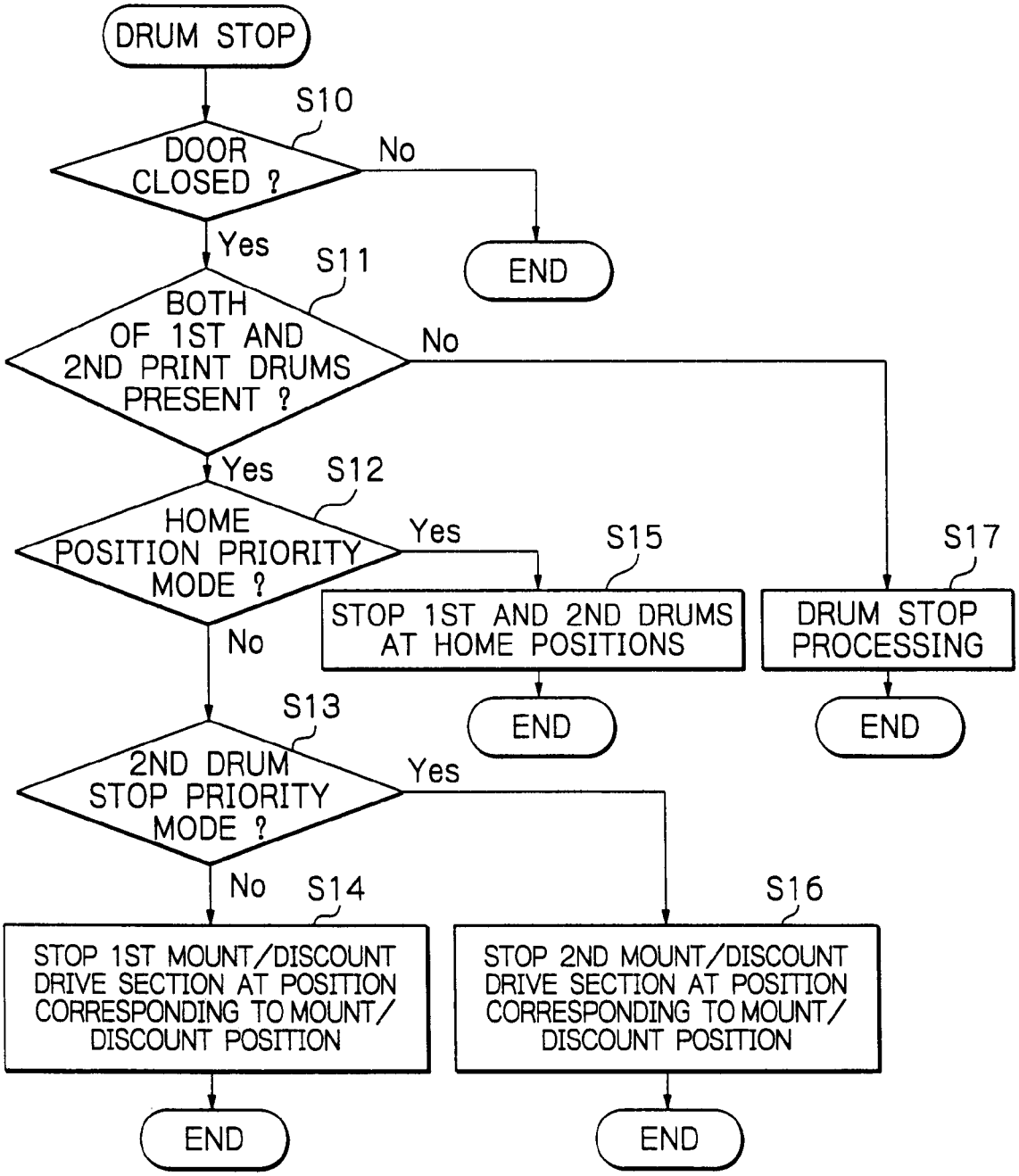
FIG. 13 is a flowchart demonstrating a second specific operation of the printer of FIG. 1.

The second specific operation shown in FIG. 13 is effected when the operator intends to, e.g., perform a desired stopping operation by interrupting or neglecting the priority order of the print drums 1*a* and 1*b* stored in the ROM 203. The second specific operation is implemented mainly by the third to seventh functions available with the controller 200.

As shown in FIG. 13, the controller 200 determines whether or not the door 503 is closed on the basis of the output of the door sensor 504 (step S10). If the answer of the step S1 is Yes, the controller 200 determines whether or not the first and second print drums 1*a* and 1*b* both are present in the body frame 501 on the basis of the outputs of the first and second drum sensors 77 and 78 (step S11). If the answer of the step S10 is No, the controller 200 ends the drum stop processing.

If the answer of the step S11 is Yes, the controller 200 executes a step S12. If the answer of the step S11 is No, the controller 200 executes a step S17 by determining that neither one of the print drums 1*a* and 1*b* is present in the body frame 501 or that one of them is absent in the body frame 501. In the step S17, the subroutine described in relation to the steps S3, S4 and S5 of FIG. 12 is executed.

In the step S12, the controller 200 determines whether or not the home stop priority mode is selected. Assume that the operator has sequentially pressed the initial set key 180, home stop priority key 176 and enter key 174 in this order (Yes, step S12). In this case, a home stop priority signal is sent to the controller 200. In response, the controller 200 turns on the lamp 177 to show the operator that the home stop priority mode is set up. The controller 200 then stops the print drums 1*a* and 1*b* at the respective home positions (step S15) in the same manner as in the step S6 of FIG. 12.

If the answer of the step S12 is No, the controller 200 determines whether or not the second drum stop priority mode is selected (step S13). Assume that the operator has sequentially pressed the initial set key 180, second drum stop priority key 178 and enter key 174 in this order (Yes, step S12). Then, in response to a second drum stop priority signal, the controller 200 turns on the lamp 179 to shown the operator that the second drum stop priority mode is set up. Subsequently, the controller 200 executes a step S16.

In the step S16, the controller 200 controls the main motor 81 such that the specified second print drum 1*b* rotates to the mount/dismount position. Subsequently, in response to a mount/dismount signal output from the mount/dismount position sensor 104*b*, the controller 200 controls the main motor 81 such that the second print drum 1*b* and mount/dismount drive section 95*b* assigned thereto rotate to the mount/dismount position and position corresponding thereto, respectively. This condition is shown in FIG. 10. At this time, the LCD 175 shows the operator that the drum unit 100*b* (print drum 1*b*) is ready to be pulled out of the body frame 501. The operator, watching the LCD 175, opens the door 503 and can easily pull out the drum unit 100*b* via the mounting/dismounting means 50*b* and opening 501*b*.

If the answer of the step S13 is No, the controller 200 controls the main motor 81 such that the print drum 1*a* rotates to the mount/dismount position. In response to the resulting mount/dismount position signal output from the sensor 104*a*, the controller 200 so controls the main motor 81 as to stop the print drum 1*a* and mount/dismount drive section 95*a* assigned thereto at the mount/dismount position and position corresponding thereto, respectively. This condition is shown in FIG. 9. At this time, the LCD 175 shows the operator that the drum unit 100*a* (print drum 1*a*) is ready to be pulled out of the body frame 501. The operator, watching the LCD 175, opens the door 503 and can easily pull out the drum unit 100*a* via the mounting/dismounting means 50*a* and opening 501*a*.

In this manner, if neither the home stop priority mode nor the second drum stop priority mode is set up, i.e., if the print drums 1*a* and 1*b* both are present in the body frame 501, the controller 200 stops the first drum 1*a* at the mount/dismount position in accordance with the priority order. Again, this is because the print drums 1*a*and 1*b* cannot be brought to the mount/dismount positions at the same time, i.e., the mount/dismount drive sections 95*a* and 95*b* cannot be brought to the positions corresponding to the mount/dismount positions at the same time.

As stated above, in the home stop priority mode, for example, the second specific operation obviates the leak of the ink by causing the print drums 1*a* and 1*b* to stop at the respective home positions where the dampers 5*a* and 5*b*, respectively, face upward.

As for the second drum stop priority mode, assume that the operator desires to produce printings with the print drum 1*a*continuously set in the body frame 501 while replacing the print drum 1*b*. Then, the operator may wrap the master 33*a* formed only with a frame or similar form around the print drum 1*a* and wrap the master 33*b* formed with text data or graphic data around the print drum 1*b*. Specifically, in a printer storing a program for selectively executing a first drum stop priority mode or a home stop priority mode, the second print drum 1*b* cannot be replaced unless the operator presses a second drum mount/dismount key for moving the second rum 1*b* and mount/dismount drive section 95*b* to the mount/dismount position and position corresponding thereto, respectively, as in the conventional printer. In the illustrative embodiment, only if the operator presses the initial set key 180, second drum stop priority key 178 and enter key 174 once, the second drum stop priority mode is set. Therefore, any time the operator opens the door 503, the second drum 1*b* and mount/dismount drive section 1*b* are held stationary at the mount/dismount position and position corresponding thereto, respectively. In this manner, the operator can change the priority order of the print drums 1*a* and 1*b* and select the stop position of the desired print drum 1*a* or 1*b*.

Further, as for the second specific operation, assume that the power switch 503 is turned off after the procedure shown in FIG. 13 and again turned on. Then, the controller 200 automatically turns on the lamp 177 or 179 in accordance with the program data stored in the RAM 202 and relating to the home stop priority mode or the second drum stop priority mode. This improves manipulability, compared to the conventional printer.

The illustrative embodiment and first and second specific operations unique thereto use the rotation transmitting means 83A included in the top-bottom shifting means 83. It is therefore possible to effect even the phase shift of the print drum 1*b* relative to the print drum 1*a* with the top-bottom shifting means 83. Specifically, the shift of the top-bottom position of an image to be printed by the drum 1*a* relative to the paper sheet 22 can be accurately effected in the direction of paper conveyance X only if the drive timing of the registration motor 47 is controlled.

If the above described advantages available with the rotation transmitting means 84A are not important, the upper pulley 87, lower pulley 88, four shafts 89 and four stationary pulleys 90 through 93 constituting the rotation transmitting means 83 may be omitted. In such a case, the drive transmitting means may be implemented by a belt connecting the drum pulleys 86*a* and 86*b*, but shorter than the belt 94.

A stencil printer designated by the parenthesized reference numeral 700 in FIGS. 1 and 6 and representative of a modification of the illustrative embodiment will be described hereinafter. The stencil printer includes the previously mentioned master making devices 41*a* and 41*b*, FIG. 1, master discharging devices 42*a* and 42*b*, FIG. 1, an operation panel designated by the parenthesized reference numeral 190, and a scanner not shown. The scanner is arranged above the master making devices 41*a* and 41*b* and master discharging devices 42*a* and 42*b*.

The master making devices 41*a* and 41*b*, master discharging devices 42*a* and 42*b* and scanner each may be constructed as shown in, e.g., FIG. 8 of Laid-Open Publication No. 5-229243. The scanner has various functions necessary for color separation essential with color printing. For example, a filter unit including a plurality of color filters, as taught in Laid-Open Publication No. 64-18682 is arranged on an optical path between a group of mirrors and a lens disposed in the scanner. An automatic master making and master feeding procedure is effected in the same manner as shown and described in Laid-Open Publication No. 64-18682. Data for perforating a stencil may be data output from the scanner or data generated by, e.g., a computer.

The operation panel 190 differs from the operation panel 170 of the illustrative embodiment in that it additionally includes the previously mentioned perforation start key 171, FIG. 7.

The stencil printer 700 operates in the same manner as in the above Laid-Open Publication No. 11-138961 and will not be described specifically. The first and second specific operations described previously are, of course, practical with the stencil printer 700.

It is to be noted the configuration and position of the individual structural element included in the stencil printer 500 or 700 is only illustrative. For example, the air knives 7*a* and 7*b* may be replaced with conventional separators angularly movable toward and away from the print drums 1*a* and 1*b*, respectively. Also, the home stop priority setting means (initial set key 180, home stop priority key 176 and enter key 174) and specified drum priority setting means (initial set key 180, second drum stop priority key 178 and enter key 174) are not essential. That is, only the construction implementing the first specific operation suffices.

If desired, the home stop priority setting means (keys 180, 176 and 174) and the third function of the controller 200 may be combined, or the specified drum stop priority setting means (keys 180, 178 and 174) and the fourth function of the controller 200 may be combined. In such a case, an arrangement will be made such that the decisions in the steps S12 and S13, FIG. 13, relating to the second specific operation are made independently of each other. Of course, the lamps 177 and 179 may be omitted if the advantage thereof in the visual aspect is not important.

Again, the present invention is practicable with a stencil printer including three or more print drums. For example, a plurality of print drums may be arranged in a stencil printer disclosed in Laid-Open Publication No. 7-17013, in which ink is fed to a master wrapped around a print drum from the outside of the print drum.

In summary, it will be seen that the present invention provides a printer with a plurality of print drums having various unprecedented advantages, as enumerated below.

(1) It is not necessary for a person or operator, intending to mount a print drum to the printer body, to press a drum mount/dismount key each time while wasting time. The printer is therefore easy and convenient to operate.

(2) When print drums are brought to their home positions, dampers mounted thereon face upward. This obviates the leakage of ink.

(3) The operator can select the home position as a drum stop position, neglecting a preselected priority order given to the stop positions of the drums.

(4) The printer obviates operator's frequent operation of home stop priority setting means and therefore features desirable manipulability.

(5) The operator can designate a particular print drum, neglecting the preselected priority order. The operator can therefore select, as a stop position, a preselected phase in which the designated print drum is removable from the printer body.

(6) The printer obviates operator's frequent operation of specified drum stop priority setting means and therefore features desirable manipulability.

(7) The printer can rotate the print drums without resorting to any extra means and can shift the top-bottom position of an image relative to a recording medium.

Various modifications will become possible for those skilled in the art after receiving the teachings of the present disclosure without departing from the scope thereof.

What is claimed is:

1. A printer including a body and a plurality of print drums removably mounted to said body for wrapping masters therearound, and providing an initial phase difference between nearby print drums set in said body such that said print drums each can be mounted to said body in a particular preselected phase, and feeding ink to said masters while sequentially pressing a recording medium against said masters to thereby sequentially form images on said recording medium one above the other, said printer comprising:

an opening/closing member mounted on said body and movable between a closed position where said opening/closing member covers openings each for mounting and dismounting a particular print drum and an open position where said opening/closing member uncovers said openings;

closed position sensing means responsive to the closed position of said opening/closing member;

drum drive means for causing each of said print drums to rotate;

drum sensing means each being assigned to a particular print drum for determining whether or not said particular print drum is present in said body;

mount/dismount drive means mounted on said body and each being assigned to a particular print drum such that the mount/dismount drive means is connected to said particular print drum, which is to be mounted to said body, and said drum drive means only at a position corresponding to a mount position of said particular print drum, which corresponds to the preselected phase;

mount position sensing means each for sensing a position of associated one of said mount/dismount drive means corresponding to the mount position; and control means for controlling, in response to a close signal output from said closed position sensing means and an absence signal output from said drum sensing means assigned to the print drum to be mounted, said drum drive means such that said mount/dismount drive means assigned to said print drum to be mounted takes the position corresponding to the mount position, and controlling, in response to a mount position signal output from said mount position sensing means, said drum drive means such that said mount/dismount drive means stops at said position corresponding to said mount position.

2. A printer as claimed in claim 1, wherein said print drums each are capable of stopping at a respective home position different from the preselected phase, said printer further comprising home position sensing means each being responsive to the home position of a particular print drum.

3. A printer as claimed in claim 2, wherein said control means controls, in response to the close signal output from said closed position sensing means and a presence signal output from said drum sensing, said drum drive means such that said print drums each take the respective home position and controls, in response to home position signals output from said home position sensing means, said drum drive means such that said print drums stop at the home positions.

4. A printer as claimed in claim 1, further comprising top-bottom shifting means including rotation transmitting means for transmitting a rotational drive force output from said drum drive means to said print drums for thereby varying a phase of each of said print drums, wherein said drum drive means causes said print drums to rotate via said rotation transmitting means.

5. A printer including a body and a plurality of print drums removably mounted to said body for wrapping masters therearound, and providing an initial phase difference between nearby print drums, and feeding ink to said masters while sequentially pressing a recording medium against said masters to thereby sequentially form images on said recording medium one above the other, said plurality of print drums each being capable of stopping at a respective home position, said printer comprising:

home position sensing means each being responsive to the home position of a particular print drum;

home stop priority setting means for allowing an operator of said printer to select a home stop priority mode, which causes said print drums to stop at respective home positions, neglecting a preselected priority order given to stop positions of said print drums;

an opening/closing member mounted on said body and movable between a closed position where said opening/closing member covers openings each for mounting and dismounting a particular print drum and an open position where said opening/closing member uncovers said openings;

closed position sensing means responsive to the closed position of said opening/closing member;

drum drive means for causing each of said print drums to rotate;

drum sensing means each being assigned to a particular drum for determining whether or not said particular print drum is present in said body; and control means for controlling, in response to a close signal output from said closed position sensing means, presence signals output from said drum sensing means and a home stop priority signal output from said home stop priority setting means, said drum drive means such that said print drums each take the respective home position, and controlling, in response to home position signals output from said home position sensing means, said drum drive means such that said print drums each stop at the respective home position.

6. A printer as claimed in claim 5, further comprising storing means for storing, even after a power source of said printer has been turned off, data representative of said home stop priority mode set by said home stop priority setting means.

7. A printer as claimed in claim 5, further comprising top-bottom shifting means including rotation transmitting means for transmitting a rotational drive force output from said drum drive means to said print drums for thereby varying a phase of each of said print drums, wherein said drum drive means causes said print drums to rotate via said rotation transmitting means.

8. A printer including a body and a plurality of print drums removably mounted to said body for wrapping masters therearound, and providing an initial phase difference between nearby print drums set in said body such that said print drums each can be dismounted from said body in a preselected phase, and feeding ink to said masters while sequentially pressing a recording medium against said masters to thereby sequentially form images on said recording medium one above the other, said printer comprising:

specified drum stop priority setting means for allowing an operator of said printer to select a specified drum stop priority mode, which causes any one of said print drums to stop in the preselected phase, neglecting a preselected priority order given to stop positions of said print drums;

an opening/closing member mounted on said body and movable between a closed position where said opening/closing member covers openings each for mounting and dismounting a particular print drum and an open position where said opening/closing member uncovers said openings;

closed position sensing means responsive to the closed position of said opening/closing member;

drum drive means for causing each of said print drums to rotate;

drum sensing means each being assigned to a particular drum for determining whether or not said particular print drum is present in said body;

mount/dismount position sensing means mounted on said body and each being assigned to a particular print drum for sensing the preselected phase of said particular print drum; and control means for controlling, in response to a close signal output from said closed position sensing means, presence signals output from said drum sensing means and a specified drum stop priority signal output from said specified drum stop priority setting means, said drum drive means such that the print drum specified takes the preselected phase, and controlling, in response to a mount/dismount position signal output from said mount/dismount position sensing means, said drum drive means such that said print drum specified stops at a mount/dismount position.

9. A printer as claimed in claim 8, further comprising:

storing means for storing, even after a power source of said printer has been turned off, data representative of a home stop priority mode set by said specified drum stop priority setting means.

10. A printer as claimed in claim 8, further comprising top-bottom shifting means including rotation transmitting means for transmitting a rotational drive force output from said drum drive means to said print drums for thereby varying a phase of each of said print drums, wherein said drum drive means causes said print drums to rotate via said rotation transmitting means.

11. A printer including a body and a plurality of print drums removably mounted to said body for wrapping masters therearound, and providing an initial phase difference between nearby print drums set in said body such that said print drums each can be mounted to said body in a preselected phase, and feeding ink to said masters while sequentially pressing a recording medium against said masters to thereby sequentially form images on said recording medium one above the other, said printer comprising:

an opening/closing member mounted on said body and movable between a closed position where said opening/closing member covers openings each for mounting and dismounting a particular print drum and an open position where said opening/closing member uncovers said openings;

a closed position sensor responsive to the closed position of said opening/closing member;

a drum driving device constructed to cause each of said print drums to rotate;

drum sensors each being assigned to a particular print drum for determining whether or not said particular print drum is present in said body;

mount/dismount drive sections mounted on said body and each being assigned to a particular print drum such that the mount/dismount drive section is connected to said particular print drum, which is to be mounted to said body, and said drum driving device only at a position corresponding to a mount position of said particular print drum, which corresponds to the preselected phase;

mount position sensors each being responsive to a position of associated one of said mount/dismount drive sections corresponding to the mount position; and a controller constructed to control, in response to a close signal output from said closed position sensor and an absence signal output from said drum sensor assigned to the print drum to be mounted, said drum driving device such that said mount/dismount drive section assigned to said print drum to be mounted takes the position corresponding to the mount position, and control, in response to a mount position signal output from said mount position sensor, said drum driving device such that said mount/dismount drive section stops at said position corresponding to said mount position.

12. A printer as claimed in claim 11, wherein said print drums each are capable of stopping at a respective home position different from the preselected phase, said printer further comprising home position sensors each being responsive to the home position of a particular print drum.

13. A printer as claimed in claim 12, wherein said controller controls, in response to the close signal output from said closed position sensor and a presence signal output from said drum sensor, said drum driving device such that said print drums each take the respective home position and controls, in response to home position signals output from said home position sensors, said drum driving device such that said print drums stop at the home positions.

14. A printer as claimed in claim 11, further comprising a top-bottom shifting device including a rotation transmitting section constructed to transmit a rotational drive force output from said drum driving device to said print drums for thereby varying a phase of each of said print drums, wherein said drum driving device causes said print drums to rotate via said rotation transmitting section.

15. A printer including a body and a plurality of print drums removably mounted to said body for wrapping masters therearound, and providing an initial phase difference between nearby print drums, and feeding ink to said masters while sequentially pressing a recording medium against said masters to thereby sequentially form images on said recording medium one above the other, said plurality of print drums each being capable of stopping at a respective home position, said printer comprising:

home position sensors each being responsive to the home position of a particular print drum;

a home stop priority setting device constructed to allow an operator of said printer to select a home stop priority mode, which causes said print drums to stop at respective home positions, neglecting a preselected priority order given to stop positions of said print drums;

an opening/closing member mounted on said body and movable between a closed position where said opening/closing member covers openings each for mounting and dismounting a particular print drum and an open position where said opening/closing member uncovers said openings;

a closed position sensor responsive to the closed position of said opening/closing member;

a drum driving device constructed to cause each of said print drums to rotate;

drum sensors each being assigned to a particular drum for determining whether or not said particular print drum is present in said body; and a controller constructed to control, in response to a close signal output from said closed position sensor, presence signals output from said drum sensors and a home stop priority signal output from said home stop priority setting device, said drum driving device such that said print drums each take the respective home position, and control, in response to home position signals output from said home position sensors, said drum driving device such that said print drums each stop at the respective home position.

16. A printer as claimed in claim 15, further comprising a storage configured to store, even after a power source of said printer has been turned off, data representative of said home stop priority mode set by said home stop priority setting device.

17. A printer as claimed in claim 15, further comprising a top-bottom shifting device including a rotation transmitting section constructed to transmit a rotational drive force output from said drum driving device to said print drums for thereby varying a phase of each of said print drums, wherein said drum driving device causes said print drums to rotate via said rotation transmitting section.

18. A printer including a body and a plurality of print drums removably mounted to said body for wrapping masters therearound, and providing an initial phase difference between nearby print drums set in said body such that said print drums each can be dismounted from said body in a preselected phase, and feeding ink to said masters while sequentially pressing a recording medium against said masters to thereby sequentially form images on said recording medium one above the other, said printer comprising:

a specified drum stop priority setting device constructed to allow an operator of said printer to select a specified drum stop priority mode, which causes any one of said print drums to stop in the preselected phase, neglecting a preselected priority order given to stop positions of said print drums;

an opening/closing member mounted on said body and movable between a closed position where said opening/closing member covers openings each for mounting and dismounting a particular print drum and an open position where said opening/closing member uncovers said openings;

a closed position sensor responsive to the closed position of said opening/closing member;

a drum driving device constructed to cause each of said print drums to rotate;

drum sensors each being assigned to a particular drum for determining whether or not said particular print drum is present in said body;

mount/dismount position sensors mounted on said body and each being assigned to a particular print drum for sensing the preselected phase of said particular print drum; and a controller constructed to control, in response to a close signal output from said closed position sensor, presence signals output from said drum sensors and a specified drum stop priority signal output from said specified drum stop priority setting device, said drum driving device such that the print drum specified takes the preselected phase, and control, in response to a mount/dismount position signal output from said mount/dismount position sensor, said drum driving device such that said print drum specified stops at a mount/dismount position.

19. A printer as claimed in claim 18, further comprising:

a storage configured to store, even after a power source of said printer has been turned off, data representative of a home stop priority mode set by said specified drum stop priority setting device.

20. A printer as claimed in claim 18, further comprising a top-bottom shifting device including a rotation transmitting section for transmitting a rotational drive force output from said drum driving device to said print drums for thereby varying a phase of each of said print drums, wherein said drum driving device causes said print drums to rotate via said rotation transmitting section.

* * * * *

UNITED STATES PATENT AND TRADEMARK OFFICE

CERTIFICATE OF CORRECTION

PATENT NO. : 6,427,586 B2
DATED : August 6, 2002
INVENTOR(S) : Mituru Takahashi

It is certified that error appears in the above-identified patent and that said Letters Patent is hereby corrected as shown below:

Column 1,
Lines 50, 54, 61 and 64, change “damper” to -- clamper --.

Column 3,
Line 19, change “re” to -- are --.

Column 5,
Line 54, change “dampers” to -- clampers --;
Line 61, insert -- is -- after “It”.

Column 9,
Line 18, change “he bracket” to -- the bracket --.

Column 13,
Lines 1 and 7, change “damper” to -- clamper --.

Column 14,
Line 29, change “damper” to -- clamper --.

Column 15,
Lines 14, 28 and 58, change “damper” to -- clamper --;
Line 29, remove “that”.

Column 20,
Line 7, change “control” to -- controls --;
Line 37, change “drop” to -- stop --.

Column 21,
Lines 24 and 26, change “damper” to -- clamper --.

Column 22,
Line 8, remove “5”;
Line 62, change “damper” to -- clamper --.

Column 25,
Line 60, change “shown” to -- show --.

UNITED STATES PATENT AND TRADEMARK OFFICE

CERTIFICATE OF CORRECTION

PATENT NO. : 6,427,586 B2
DATED : August 6, 2002
INVENTOR(S) : Mituru Takahashi

It is certified that error appears in the above-identified patent and that said Letters Patent is hereby corrected as shown below:

Column 26,
Lines 38 and 42, change “dampers” to -- clampers --;
Line 42, put space after “1a”;
Line 51, change “rum” to -- drum --.

Column 28,
Line 22, change “dampers” to -- clampers --.

Signed and Sealed this

Fifth Day of August, 2003

JAMES E. ROGAN
*Director of the United States Patent and Trademark Office*